US010906306B2

(12) United States Patent
Tamai et al.

(10) Patent No.: US 10,906,306 B2
(45) Date of Patent: Feb. 2, 2021

(54) LIQUID EJECTING HEAD AND LIQUID EJECTING APPARATUS

(71) Applicant: SEIKO EPSON CORPORATION, Tokyo (JP)

(72) Inventors: Shotaro Tamai, Shiojiri (JP); Kazuaki Uchida, Fujimi-Machi (JP); Akinori Taniuchi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/722,597

(22) Filed: Dec. 20, 2019

(65) Prior Publication Data

US 2020/0198348 A1 Jun. 25, 2020

(30) Foreign Application Priority Data

Dec. 21, 2018 (JP) ..... 2018-239222

(51) Int. Cl.
*B41J 2/14* (2006.01)

(52) U.S. Cl.
CPC ..... *B41J 2/14145* (2013.01); *B41J 2/14201* (2013.01); *B41J 2002/14306* (2013.01); *B41J 2002/14419* (2013.01)

(58) Field of Classification Search
CPC ..... B41J 2/14145; B41J 2/14201; B41J 2002/14419; B41J 2002/14491; B41J 2002/14241; B41J 2202/11; B41J 2202/12; B41J 2/14233; B41J 2/175; B41J 2/18; B41J 2/01
See application file for complete search history.

(56) References Cited

U.S. PATENT DOCUMENTS

| | | | | |
|---|---|---|---|---|
| 8,899,724 | B2 * | 12/2014 | Akahane | B41J 2/14233 347/47 |
| 10,493,758 | B2 | 12/2019 | Giusti et al. | |
| 10,730,306 | B2 * | 8/2020 | Koide | B41J 2/145 |
| 10,759,165 | B2 * | 9/2020 | Iwata | B41J 2/14201 |
| 2011/0216129 | A1 | 9/2011 | Kusunoki et al. | |
| 2012/0176450 | A1 | 7/2012 | Akahane et al. | |
| 2015/0258788 | A1 * | 9/2015 | Togashi | B41J 2/14145 347/65 |
| 2018/0272709 | A1 | 9/2018 | Iwata et al. | |

(Continued)

FOREIGN PATENT DOCUMENTS

| | | |
|---|---|---|
| EP | 2363291 | 9/2011 |
| EP | 3381690 | 10/2018 |

(Continued)

*Primary Examiner* — Huan H Tran
(74) *Attorney, Agent, or Firm* — Workman Nydegger

(57) ABSTRACT

The individual flow path includes a nozzle communicating with an outside, a first flow path, in the middle of which the nozzle is disposed and which extends in a first direction that is an in-plane direction of a nozzle surface of the nozzle plate in which the nozzle opens, a second flow path coupled to the first flow path and extending in a second direction other than the first direction, a third flow path coupled to the second flow path and extending in the third direction other than the second direction, and a pressure chamber which is disposed in the third flow path and in which a pressure change is induced by the energy generating element. A cross-sectional area of the first flow path is smaller than a cross-sectional area of the second flow path.

12 Claims, 16 Drawing Sheets

(56) References Cited

U.S. PATENT DOCUMENTS

| | | | |
|---|---|---|---|
| 2018/0281402 | A1 | 10/2018 | Giusti et al. |
| 2019/0299620 | A1 | 10/2019 | Koide et al. |

FOREIGN PATENT DOCUMENTS

| | | |
|---|---|---|
| EP | 3546219 | 10/2019 |
| JP | 2012143948 | 8/2012 |
| JP | 2018154095 | 10/2018 |

* cited by examiner

LIQUID EJECTING HEAD AND LIQUID EJECTING APPARATUS

The present application is based on, and claims priority from JP Application Serial Number 2018-239222, filed Dec. 21, 2018, the disclosure of which is hereby incorporated by reference herein in its entirety.

BACKGROUND

1. Technical Field

The present disclosure relates to a liquid ejecting head and a liquid ejecting apparatus which eject a liquid from a nozzle, particularly, to an ink jet type recording head and an ink jet type recording apparatus which discharge an ink as a liquid.

2. Related Art

As a liquid ejecting head that ejects a liquid, there is known an ink jet type recording head that performs printing by discharging an ink as a liquid onto a printed medium.

The ink jet type recording head includes an individual flow path having a pressure chamber that communicates with a nozzle, a common liquid chamber that communicates in common with a plurality of the individual flow paths, and an energy generating element such as a piezoelectric actuator that induces a change in the pressure of the ink in the pressure chamber. If the energy generating element induces a change in the pressure of the ink in the pressure chamber, ink droplets are discharged from the nozzle.

In the ink jet type recording head described above, if air bubbles stay in the pressure chamber, the air bubbles absorb the pressure change induced by the energy generating element, and thus it is not possible to normally discharge the ink droplets from the nozzle.

For this reason, there is proposed an ink jet type recording head having a configuration where a first common liquid chamber and a second common liquid chamber are provided as common liquid chambers which are in common with individual flow paths, and an ink flows, namely, so-called circulation is performed from the first common liquid chamber to the second common liquid chamber through the individual flow paths (for example, refer to JP-A-2012-143948).

However, there occurs a problem like the occurrence of a discharge defect such as the ink being thickened in the vicinity of the nozzle, the nozzle being clogged by air bubbles that infiltrate from the nozzle, or a deviation in the flying direction of ink droplets.

The above-mentioned problem exists not only in the ink jet type recording head, similarly but also in liquid ejecting heads that eject liquids other than an ink.

SUMMARY

An advantage of some aspects of the present disclosure is to provide a liquid ejecting head and a liquid ejecting apparatus which are capable of preventing a discharge defect by removing a thickened liquid in the vicinity of a nozzle and air bubbles.

According to an aspect of the present disclosure, there is provided a liquid ejecting head including a flow path substrate which includes a nozzle plate and in which a flow path is formed; and an energy generating element inducing a change in a pressure of a liquid in the flow path. The flow path includes a first common liquid chamber, a second common liquid chamber, and a plurality of individual flow paths which are coupled to the first common liquid chamber and the second common liquid chamber and through which the liquid flows from the first common liquid chamber toward the second common liquid chamber. The individual flow path includes a nozzle communicating with an outside, a first flow path, in the middle of which the nozzle is disposed and which extends in a first direction that is an in-plane direction of a nozzle surface of the nozzle plate in which the nozzle opens, a second flow path coupled to the first flow path and extending in a second direction other than the first direction, a third flow path coupled to the second flow path and extending in a third direction other than the second direction, and a pressure chamber which is disposed in the third flow path and in which a pressure change is induced by the energy generating element. A cross-sectional area of the first flow path is smaller than a cross-sectional area of the second flow path.

In addition, according to another aspect, there is provided a liquid ejecting apparatus including the liquid ejecting head described in the aspect.

DESCRIPTION OF EXEMPLARY EMBODIMENTS

Hereinafter, the present disclosure will be described in detail based on embodiments. However, the following description illustrates one aspect of the present disclosure, and can be arbitrarily changed within the scope of the present disclosure. In each drawing, the same reference signs are assigned to the same members, and the description will be appropriately omitted. In addition, in each drawing, X, Y, and Z denote three space axes that orthogonally intersect each other. In the specification, directions along the axes are an X direction, a Y direction, and a Z direction, respectively. In each drawing, a direction pointed by an arrow is described as a positive (+) direction, and a direction opposite to the arrow is described as a negative (−) direction. In addition, the Z direction indicates a vertical direction, a +Z direction indicates a vertical downward direction, and a −Z direction indicates a vertical upward direction.

Embodiment 1

Figure 1:
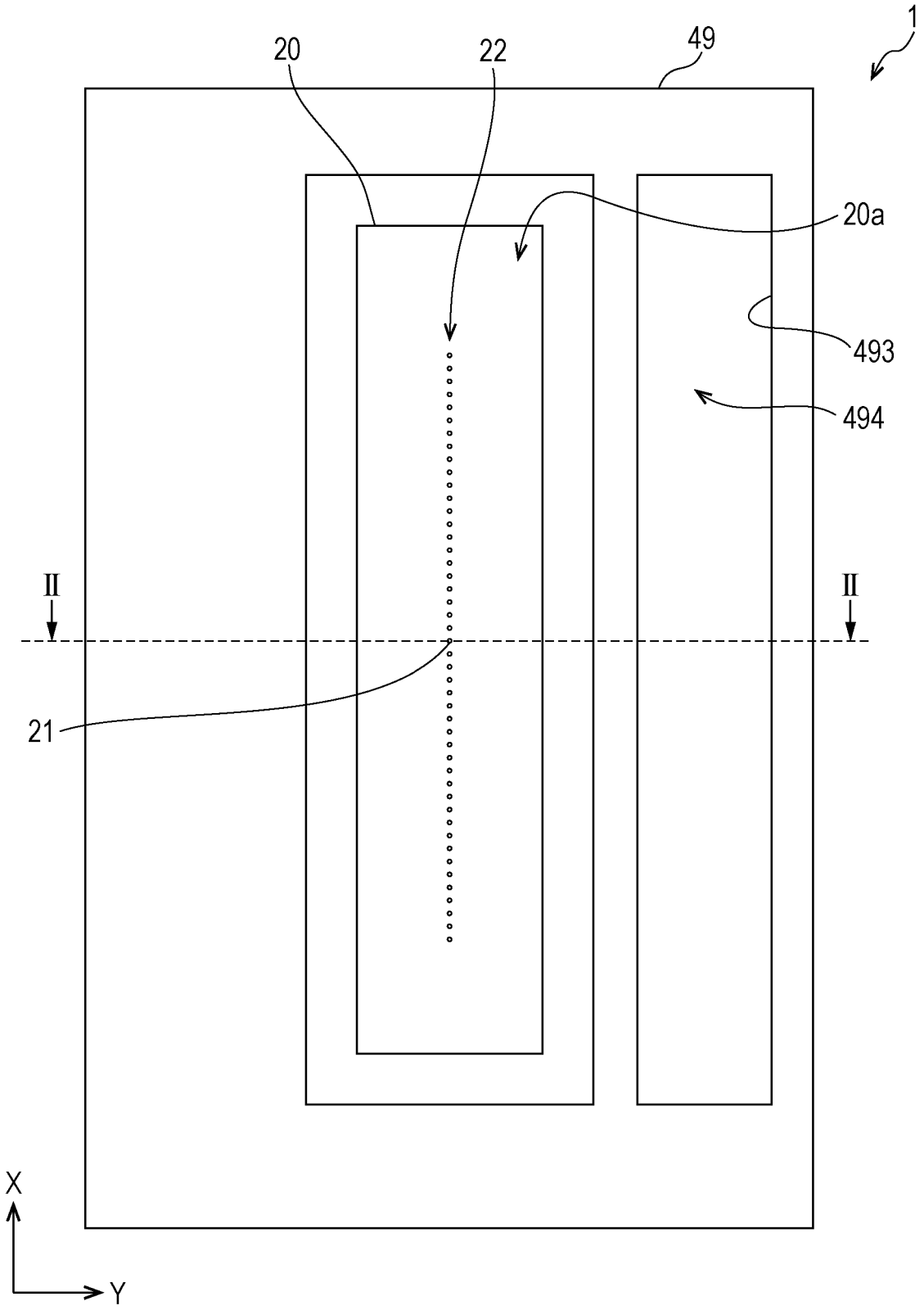
FIG. 1 is a plan view of a recording head according to Embodiment 1 of the present disclosure.
Figure 2:
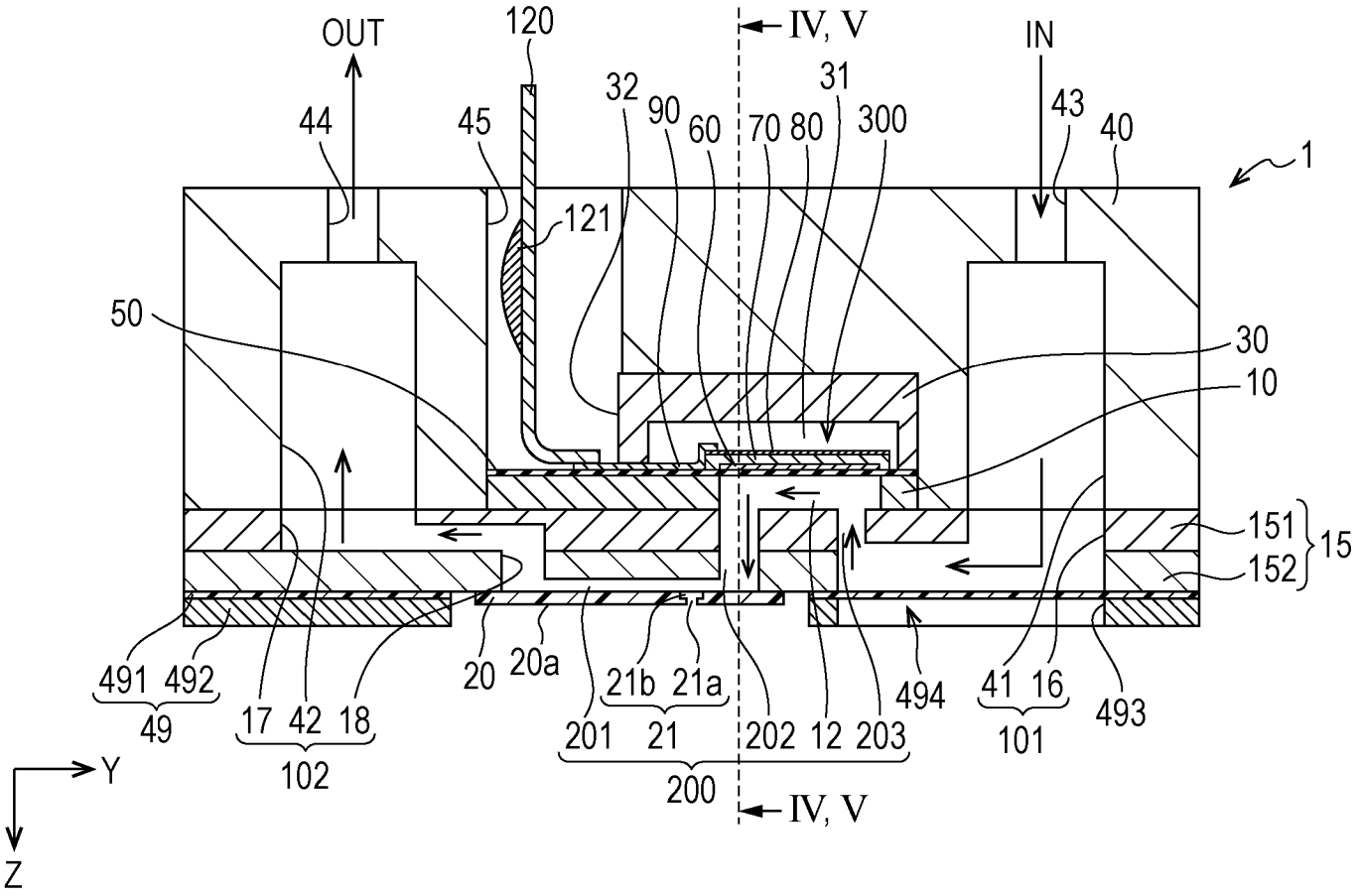
FIG. 2 is a cross-sectional view of the recording head according to Embodiment 1 of the present disclosure.
Figure 3:
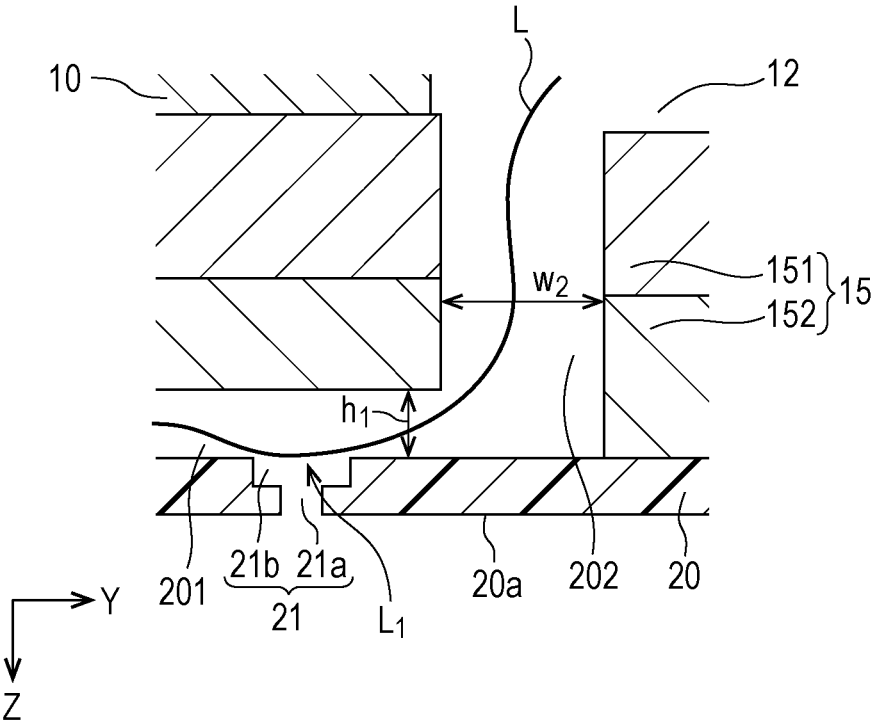
FIG. 3 is a cross-sectional view of the recording head according to Embodiment 1 of the present disclosure.
Figure 4:
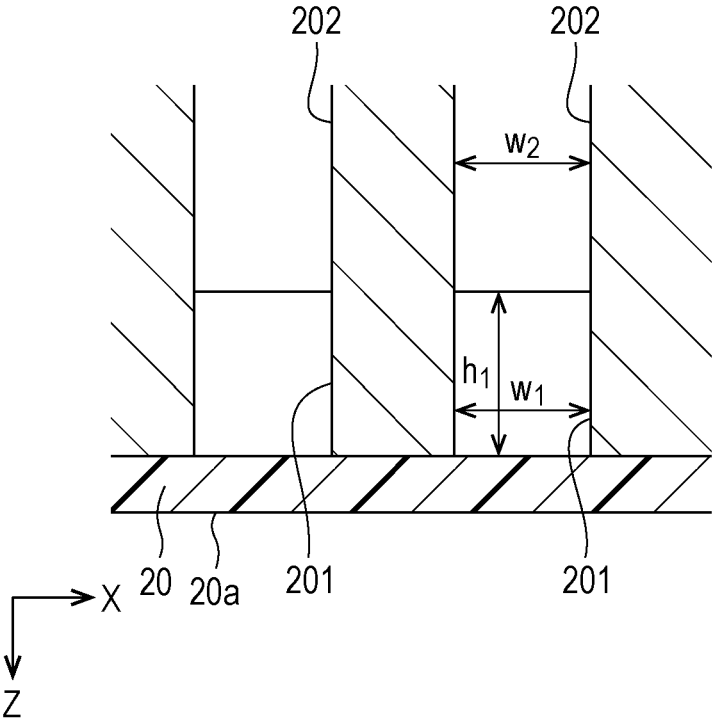
FIG. 4 is a cross-sectional view of the recording head according to Embodiment 1 of the present disclosure.
Figure 5:
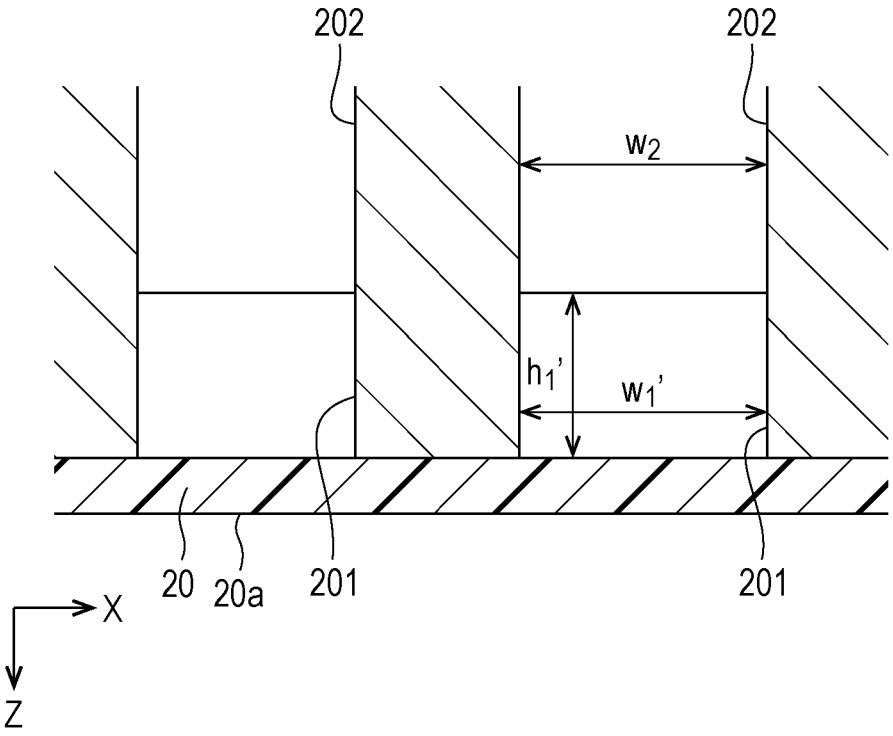
FIG. 5 is a cross-sectional view of the recording head according to Embodiment 1 of the present disclosure.

An ink jet type recording head which is one example of a liquid ejecting head of an embodiment will be described with reference to FIGS. 1 to 5. Incidentally, FIG. 1 is a plan view of the ink jet type recording head which is one example of a liquid ejecting head according to Embodiment 1 of the present disclosure, which is seen from a nozzle surface side. FIG. 2 is a cross-sectional view taken along a line II-II in FIG. 1. FIG. 3 is an enlarged view of a main part in FIG. 2. FIGS. 4 and 5 are cross-sectional views taken along a line IV-IV and V-V in FIG. 2.

An ink jet type recording head 1 (hereinafter, referred to simply also as a recording head 1) which is one example of the liquid ejecting head of the embodiment includes, as illustrated, a plurality of members as a flow path substrate such as a flow path formation substrate 10, a communication plate 15, a nozzle plate 20, a protection substrate 30, a case member 40, and a compliance substrate 49.

The flow path formation substrate 10 is made of a single crystal silicon substrate, and a vibrating plate 50 is formed on one surface thereof. The vibrating plate 50 may be a single layer or a lamination layer selected from a silicon dioxide layer or a zirconium oxide layer.

The flow path formation substrate 10 is provided with a plurality of pressure chambers 12 which form individual flow paths 200 and are partitioned off by a plurality of partition walls. The plurality of pressure chambers 12 are arranged side by side at a predetermined pitch along the X direction where a plurality of nozzles 21 discharging an ink are arranged side by side. In addition, in the embodiment, one row of the pressure chambers 12 are arranged side by side in the X direction. In addition, the flow path formation substrate 10 is disposed such that an in-plane direction includes the X direction and the Y direction. Incidentally, in the embodiment, a portion between the pressure chambers 12 which are arranged side by side in the flow path formation substrate 10 in the X direction is referred to as a partition wall. The partition wall is formed along the Y direction. Namely, the partition wall refers to a portion that overlaps the pressure chamber 12 of the flow path formation substrate 10 in the Y direction.

Incidentally, in the embodiment, the flow path formation substrate 10 is provided only with the pressure chamber 12, but may be provided with a flow path resistance application portion having a flow path cross-sectional area smaller than that of the pressure chamber 12 so as to apply a flow path resistance to the ink to be supplied to the pressure chamber 12.

The vibrating plate 50 is formed on one surface side of the flow path formation substrate 10 described above in the −Z direction. A piezoelectric actuator 300 is formed by laminating a first electrode 60, a piezoelectric layer 70, and a second electrode 80 on the vibrating plate 50 by deposition and lithography. In the embodiment, the piezoelectric actuator 300 is an energy generating element that induces a change in the pressure of the ink in the pressure chamber 12. Herein, the piezoelectric actuator 300 is referred to also as a piezoelectric element, and refers to a portion including the first electrode 60, the piezoelectric layer 70, and the second electrode 80. Generally, either one electrode of the piezoelectric actuator 300 is configured as a common electrode, and the other electrode and the piezoelectric layer 70 are formed for each of the pressure chambers 12 by patterning. In the embodiment, the first electrode 60 is formed as a common electrode of the piezoelectric actuator 300, and the second electrode 80 is formed as an individual electrode of the piezoelectric actuator 300, but even though the configuration becomes reversed for the reasons of drive circuits or wirings, there is no problem. Incidentally, in the example described above, the vibrating plate 50 and the first electrode 60 act as a vibrating plate. However, naturally, the present disclosure is not limited to this configuration, for example, the vibrating plate 50 may not be provided, and only the first electrode 60 may act as a vibrating plate. In addition, the piezoelectric actuator 300 may serve substantially as a vibrating plate.

In addition, lead electrodes 90 are coupled to the second electrodes 80 of the piezoelectric actuators 300 described above, and a voltage is selectively applied to the piezoelectric actuators 300 via the lead electrodes 90.

In addition, the protection substrate 30 is joined to a surface of the flow path formation substrate 10, on which the piezoelectric actuator 300 is provided.

A piezoelectric actuator holding portion 31 having a space not to obstruct the motion of the piezoelectric actuator 300 is provided in a region of the protection substrate 30, which faces the piezoelectric actuator 300. The piezoelectric actuator holding portion 31 may have a space not to obstruct the motion of the piezoelectric actuator 300, and the space may be sealed or may not be sealed. In addition, in the embodiment, the piezoelectric actuator holding portion 31 is formed having a size to integrally cover a row of a plurality of the piezoelectric actuators 300 that are arranged side by side in the X direction. Naturally, the piezoelectric actuator holding portion 31 is not specifically limited to the configuration, and may individually cover the piezoelectric actuator 300, or may cover each group formed of two or more piezoelectric actuators 300 that are arranged side by side in the X direction.

Preferably, a material, for example, a glass or ceramic material having substantially the same coefficient of thermal expansion as that of the material of the flow path formation substrate 10 is used as the material of the protection substrate 30 described above. In the embodiment, the protection substrate 30 is formed of a single crystal silicon substrate which is the same material as that of the flow path formation substrate 10.

In addition, the protection substrate 30 is provided with a through hole 32 penetrating the protection substrate 30 in the Z direction. The vicinity of an end portion of the lead electrode 90 leading out from each of the piezoelectric actuators 300 extends so as to be exposed in the through hole 32, and is electrically coupled to a flexible cable 120 in the through hole 32. The flexible cable 120 is a wiring substrate having flexibility, and in the embodiment, a drive circuit 121 which is a semiconductor element is mounted thereon. Incidentally, the lead electrode 90 may be electrically coupled to the drive circuit 121 without via the flexible cable 120. In addition, the protection substrate 30 may be provided with a flow path.

In addition, the case member 40 is fixed to a −Z side of the protection substrate 30. The case member 40 is provided to be joined to a surface side of the protection substrate 30, which is opposite to the flow path formation substrate 10, and to be joined also to the communication plate 15 (to be described later).

The case member 40 described above is provided with a first liquid chamber portion 41 forming part of a first common liquid chamber 101, and a second liquid chamber portion 42 forming part of a second common liquid chamber 102. The first liquid chamber portion 41 and the second liquid chamber portion 42 are provided on both sides in the Y direction, respectively, where one row of the pressure chambers 12 are interposed therebetween.

Each of the first liquid chamber portion 41 and the second liquid chamber portion 42 has a recessed shape that opens in a +Z side surface of the case member 40, and is continuously provided over the plurality of pressure chambers 12 that are arranged side by side in the X direction.

In addition, the case member 40 is provided with an inlet port 43 which communicates with the first liquid chamber portion 41 and through which the ink flows into the first liquid chamber portion 41, and an outlet port 44 which communicates with the second liquid chamber portion 42 and through which the ink flows out from the second liquid chamber portion 42.

Furthermore, the case member 40 is provided with a coupling port 45 which communicates with the through hole 32 of the protection substrate 30, and into which the flexible cable 120 is inserted.

On the one hand, the communication plate 15, the nozzle plate 20, and the compliance substrate 49 are provided on the +Z side that is a surface side of the flow path formation substrate 10, which is opposite to the protection substrate 30.

The nozzle plate 20 is provided with the plurality of nozzles 21 which communicate with the outside and communicate with the pressure chambers 12. In the embodiment, as illustrated in FIG. 1, the plurality of nozzles 21 are disposed on a straight line along the X direction.

The nozzle 21 has a first hole 21*a* and a second hole 21*b* which have different inner diameters. The first hole 21*a* and the second hole 21*b* are disposed side by side in the Z direction which is a thickness direction of the nozzle plate 20. The inner diameter of the first hole 21*a* is smaller than the inner diameter of the second hole 21*b*. The first hole 21*a* of the nozzle 21 is disposed on an outside of the nozzle plate 20, namely, on the +Z side, and the second hole 21*b* is disposed on a −Z side of the nozzle plate 20, which is a side close to a first flow path 201 (to be described in detail later).

As described above, if the nozzle 21 is provided with the first hole 21*a* having a relatively small inner diameter, it is possible to improve the flow speed of the ink and the discharge speed of ink droplets to be discharged. In addition, if the nozzle 21 is provided with the second hole 21*b* having a relatively large inner diameter, when the ink flows through the individual flow path 200 from the first common liquid chamber 101 toward the second common liquid chamber 102 (to be described in detail later), namely, when so-called circulation is performed, it is possible to reduce a portion that is not influenced by the flow of circulation. Therefore, a speed gradient becomes large, and thus it is possible to easily remove the ink thickened by the nozzle 21.

Incidentally, in the embodiment, the inner diameter of the nozzle 21 is stepwise changed by the first hole 21*a* and the second hole 21*b*, but is not limited to the stepwise change. The inner diameter of the nozzle 21 may be continuously changed such that an inner surface of the nozzle 21 is an inclined surface inclined with respect to the Z direction. In addition, the shape of the nozzle 21 in a plan view from the Z direction is not specifically limited, and may be a circular shape, an oval shape, a rectangular shape, a polygonal shape, a dharma shape, or the like.

The nozzle plate 20 described above can be formed of a planar member made of metal such as stainless steel (SUS), an organic matter such as polyimide resin, or silicon. In addition, preferably, the thickness of the nozzle plate 20 is from 60 μm to 100 μm. It is possible to improve the handleability of the nozzle plate 20, and the ease to assemble the recording head 1 by using the nozzle plate 20 having the above-mentioned thickness.

In the embodiment, the communication plate 15 has a first communication plate 151 and a second communication plate 152. The first communication plate 151 and the second communication plate 152 are laminated on top of each other in the Z direction such that the first communication plate 151 is positioned close to the flow path formation substrate 10 and the second communication plate 152 is positioned close to the nozzle plate 20 in the Z direction.

The first communication plate 151 and the second communication plate 152 forming the communication plate 15 described above can be manufactured of a metallic material such as stainless steel, a glass material, or a ceramic material, or the like. Incidentally, preferably, a material having substantially the same coefficient of thermal expansion as that of the material of the flow path formation substrate 10 is used as the material of the communication plate 15. In the embodiment, the communication plate 15 is formed of a single crystal silicon substrate which is the same material as that of the flow path formation substrate 10.

The communication plate 15 is provided with a first communication portion 16 that communicates with the first liquid chamber portion 41 of the case member 40 and forms part of the first common liquid chamber 101, and a second communication portion 17 and a third communication portion 18 that communicate with the second liquid chamber portion 42 of the case member 40 and form part of the second common liquid chamber 102. In addition, the communication plate 15 is, as will be described in detail later, provided with a flow path through which the first common liquid chamber 101 communicates with the pressure chamber 12, a flow path through which the pressure chamber 12 communicates with the nozzle 21, and a flow path through which the nozzle 21 communicates with the second common liquid chamber 102. The flow paths provided in the communication plate 15 form part of the individual flow path 200.

The first communication portion 16 is provided at a position to overlap the first liquid chamber portion 41 of the case member 40 in the Z direction, and is provided open in both of +Z and −Z side surfaces of the communication plate 15, namely, is provided to penetrate the communication plate 15 in the Z direction. The first communication portion 16 communicates with the first liquid chamber portion 41 on the −Z side to form the first common liquid chamber 101. Namely, the first common liquid chamber 101 is formed of the first liquid chamber portion 41 of the case member 40 and the first communication portion 16 of the communication plate 15. In addition, the first communication portion 16 extends in the Y direction to a position on the +Z side to overlap the pressure chamber 12 in the Z direction. Incidentally, the communication plate 15 may not be provided with the first communication portion 16, and the first common liquid chamber 101 may be formed of the first liquid chamber portion 41 of the case member 40.

The second communication portion 17 is provided at a position to overlap the second liquid chamber portion 42 of the case member 40 in the Z direction, and is provided to be open in the −Z side surface of the first communication plate 151. In addition, the second communication portion 17 is provided on the +Z side so as for the width to be widened toward the nozzle 21 in a +Y direction.

The third communication portion 18 is provided to penetrate the second communication plate 152 in the Z direction at a position which permits communication with a portion of the second communication portion 17, the width of which is widened on the +Z side toward the nozzle 21 in the +Y direction. A +Z side opening of the third communication portion 18 is covered with the nozzle plate 20.

The second common liquid chamber 102 is formed of the second communication portion 17 and the third communication portion 18 provided in the communication plate 15 described above, and the second liquid chamber portion 42 provided in the case member 40. Incidentally, the communication plate 15 may not be provided with the second communication portion 17 and the third communication portion 18, and the second common liquid chamber 102 may be formed of the second liquid chamber portion 42 of the case member 40.

The compliance substrate 49 having a compliance portion 494 is provided in the +Z side surface of the communication plate 15, in which the first communication portion 16 opens. The compliance substrate 49 seals an opening of the first common liquid chamber 101, which is close to a nozzle surface 20*a*.

In the embodiment, the compliance substrate 49 described above includes a sealing film 491 made of a thin film having flexibility, and a fixation substrate 492 made of a hard material such as metal. Since a region of the fixation substrate 492 which faces the first common liquid chamber 101 becomes an opening portion 493 formed by completely removing the region in a thickness direction, part of a wall surface of the first common liquid chamber 101 becomes the compliance portion 494 which is a flexible portion sealed only with the sealing film 491 having flexibility. As described above, if the compliance portion 494 is provided in part of the wall surface of the first common liquid chamber 101, the compliance portion 494 is capable of, by being deformed, absorbing a fluctuation in the pressure of the ink in the first common liquid chamber 101.

In addition, in the embodiment, since the first common liquid chamber 101 is provided so as to open on the +Z side on which the nozzle 21 opens, the nozzle plate 20 and the compliance portion 494 are disposed on the +Z side which is the same side with respect to the individual flow path 200 having the pressure chamber 12 and the nozzle 21 in the Z direction which is a normal direction of the nozzle surface 20*a*. As described above, if the compliance portion 494 is disposed on the same side as the nozzle 21 with respect to the individual flow path 200, it is possible to provide the compliance portion 494 in a region where the nozzle 21 is not provided, and it is possible to provide the compliance portion 494 having a relatively wide area. In addition, if the compliance portion 494 and the nozzle 21 are disposed on the same side with respect to the individual flow path 200, the compliance portion 494 is disposed at a position close to the individual flow path 200, and thus the compliance portion 494 is capable of effectively absorbing a fluctuation in the pressure of the ink in the individual flow path 200.

In addition, the flow path formation substrate 10, the communication plate 15, the nozzle plate 20, the compliance substrate 49, and the like which form the flow path substrate are provided with a plurality of the individual flow paths 200 which communicate with the first common liquid chamber 101 and the second common liquid chamber 102 and deliver the ink of the first common liquid chamber 101 to the second common liquid chamber 102. Herein, the individual flow paths 200 of the embodiment communicate with the first common liquid chamber 101 and the second common liquid chamber 102, are provided for each of the nozzles 21, and include the nozzle 21. As described above, three individual flow paths 200 adjacent to each other in the X direction which is a direction where the nozzles 21 are arranged side by side are provided to communicate with the first common liquid chamber 101 and the second common liquid chamber 102. Namely, the plurality of individual flow paths 200 provided for each of the nozzles 21 are provided to communicate only with the first common liquid chamber 101 and the second common liquid chamber 102. The plurality of individual flow paths 200 do not communicate with parts other than the first common liquid chamber 101 and the second common liquid chamber 102. Namely, in the embodiment, flow paths provided with one nozzle 21 and one pressure chamber 12 are referred to as the individual flow path 200, and the individual flow paths 200 are provided communicating only with the first common liquid chamber 101 and the second common liquid chamber 102.

In addition, in the embodiment, in the individual flow path 200, flow paths closer to the first common liquid chamber 101 than the nozzle 21 are referred to as upstream flow paths, and flow paths closer to the second common liquid chamber 102 than the nozzle 21 of the individual flow path 200 are referred to as downstream flow paths.

As illustrated in FIG. 2, the individual flow path 200 includes the nozzle 21; the pressure chamber 12 forming a third flow path; the first flow path 201; a second flow path 202; and a supply path 203.

The pressure chamber 12 is, as described above, provided in the flow path formation substrate 10, and extends in the Y direction which is a third direction. Namely, the pressure chamber 12 is provided such that the supply path 203 is coupled to one end portion of the pressure chamber 12 in the Y direction, the second flow path 202 is coupled to the other end portion thereof in the Y direction, and the ink flows through the pressure chamber 12 in the Y direction. Namely, an extending direction of the pressure chamber 12 is a direction where the ink flows through the pressure chamber 12.

Since the pressure chamber 12 of the embodiment extends, as described above, in the Y direction, the pressure chamber 12 extends in a direction other than the Z direction which is a second direction where the second flow path 202 (to be described in detail later) extends.

In addition, the pressure chamber 12 forms the third flow path which is a flow path extending in the direction other than the Z direction. The third flow path of the embodiment is formed only of the pressure chamber 12. Naturally, the third flow path is not limited to the configuration. If a flow path resistance application portion having a cross-sectional area smaller than that of the pressure chamber 12 is provided so as to apply a flow path resistance to the end portions of the pressure chamber 12, the third flow path is formed of the pressure chamber 12 and the flow path resistance application portion. In addition, the pressure chamber 12 of the embodiment extends in the Y direction, but may extend in a direction that is different from the Z direction which is the second direction, or may extend in the X direction.

The supply path 203 is a flow path through which the pressure chamber 12 is coupled to the first common liquid chamber 101, and is provided to penetrate the first communication plate 151 in the Z direction. Namely, one end portion of the supply path 203 on the +Z side communicates with the first common liquid chamber 101, and the other end portion thereof on the −Z side communicates with the pressure chamber 12. The supply path 203 described above extends in the Z direction. Herein, the extending direction of the supply path 203 is a direction where the ink flows through the supply path 203.

The first flow path 201 extends in an in-plane direction of the nozzle plate 20, namely, an in-plane direction of the nozzle surface 20*a*. In the embodiment, the first flow path 201 extends in the Y direction between directions including the X direction and the Y direction which are the in-plane direction of the nozzle surface 20*a*. Namely, the first direction of the embodiment is the Y direction.

In addition, an extending direction of the first flow path 201 is a direction where the ink flows through the first flow path 201. In the embodiment, since the first flow path 201 communicates with the second flow path 202 at one end in the Y direction, and communicates with the second common liquid chamber 102 at the other end in the Y direction, the ink flows through the first flow path 201 in the Y direction. Therefore, the extending direction of the first flow path 201 is the Y direction.

The first flow path 201 described above is provided between the second communication plate 152 and the nozzle plate 20 along the Y direction. Specifically, the first flow path 201 is formed by providing a recessed portion in the second communication plate 152 and covering an opening of the recessed portion with the nozzle plate 20. Incidentally, the first flow path 201 is not specifically limited to being formed by the method, and may be formed by providing a recessed portion in the nozzle plate 20 and covering the recessed portion of the nozzle plate 20 with the second communication plate 152, or may be formed by providing recessed portions in both of the second communication plate 152 and the nozzle plate 20, respectively.

The second flow path 202 is coupled to the first flow path 201, and extends in the second direction, in the embodiment, extends in the Z direction other than the Y direction which is the first direction where the first flow path 201 extends. Herein, the extending direction of the second flow path 202 is a direction where the ink flows through the second flow path 202. In the embodiment, since the second flow path 202 is provided to penetrate the communication plate 15 in the Z direction, communicates with the pressure chamber 12 at one end in the Z direction, and communicates with the first flow path 201 at the other end in the Z direction, the pressure chamber 12 communicates with the first flow path 201. Therefore, the ink flows through the second flow path 202 in the Y direction. For this reason, the extending direction of the second flow path 202 is the Z direction.

The nozzle 21 may be disposed in the middle of the first flow path 201 so as to communicate therewith. Namely, the nozzle 21 is provided such that one end of the nozzle 21 communicates with a portion in the middle of the first flow path 201 and the other end opens in the nozzle surface 20*a* of the nozzle plate 20 on the +Z side to communicate with the outside.

Herein, the fact that the nozzle 21 is provided in the middle of the first flow path 201 so as to communicate therewith implies that the nozzle 21 is disposed at a position to overlap the first flow path 201 in the plan view from the Z direction. By the way, the fact that the nozzle 21 is disposed at a position to overlap the second flow path 202 in the plan view from the Z direction does not imply that the nozzle 21 is provided in the middle of the first flow path 201 so as to communicate therewith. Namely, the first flow path 201 of the embodiment is a portion that does not overlap the second flow path 202 in the Z direction.

In addition, the cross-sectional area of the first flow path 201, in the middle of which the nozzle 21 is provided is smaller than the cross-sectional area of the second flow path 202. Herein, the cross-sectional area of each of the first flow path 201 and the second flow path 202 is the area of a cross section across the ink flow direction. Namely, the cross-sectional area of the first flow path 201 is the area of a cross section in a direction including the X direction and the Z direction, and the cross-sectional area of the second flow path 202 is the area of a cross section in a direction including the X direction and the Y direction.

In the embodiment, since the height of the first flow path 201 in the Z direction is smaller than the height of the second flow path 202 in the Y direction, the cross-sectional area of the first flow path 201 is smaller than the cross-sectional area of the second flow path 202.

The individual flow path 200 described above has the supply path 203, the pressure chamber 12, the second flow path 202, and the first flow path 201 in the order from an upstream region communicating with the first common liquid chamber 101 toward a downstream region communicating with the second common liquid chamber 102. Namely, in the embodiment, in the individual flow path 200, the pressure chamber 12 and the nozzle 21 are disposed in the order from the upstream region toward the downstream region with respect to the flow of the ink from the first common liquid chamber 101 toward the second common liquid chamber 102.

In the individual flow path 200 described above, the ink flows, namely, so-called circulation is performed from the first common liquid chamber 101 to the second common liquid chamber 102 through the individual flow path 200. In addition, when a change in the pressure of the ink in the pressure chamber 12 is induced by driving the piezoelectric actuator 300, and the pressure of the ink in the nozzle 21 is increased, ink droplets are discharged from the nozzle 21 to the outside. When the ink flows from the first common liquid chamber 101 to the second common liquid chamber 102 through the individual flow path 200, the piezoelectric actuator 300 may be driven, and when the ink does not flow from the first common liquid chamber 101 to the second common liquid chamber 102 through the individual flow path 200B, the piezoelectric actuator 300 may be driven. In addition, the ink may temporarily flow from the second common liquid chamber 102 to the first common liquid chamber 101 due to a pressure change induced by driving the piezoelectric actuator 300.

In the embodiment described above, since the nozzle 21 communicates with a portion in the middle of the first flow path 201 having a cross-sectional area smaller than that of the second flow path 202, the ink flowing through the first flow path 201 at a high flow speed enables the ink, which is dried and thickened by the nozzle 21, to flow to the second common liquid chamber 102. Therefore, the thickened ink is prevented from staying in the nozzle 21 and in the vicinity of the nozzle 21, and thus it is possible to prevent the occurrence of a discharge defect such as the nozzle 21 being clogged by the thickened ink or a deviation in the flying direction of ink droplets discharged from the nozzle 21.

On the other hand, for example, if the nozzle 21 is disposed at a position which permits communication with the second flow path 202, namely, if the nozzle 21 is disposed at a position to overlap the second flow path 202 in the plan view from the Z direction, since the flow speed of the ink flowing through the second flow path 202 is slow compared to the flow speed of the ink flowing through the first flow path 201, the ink dried and thickened by the nozzle 21 is likely to stay at corners between the second flow path 202 and the nozzle plate 20, particularly, at a corner opposite to the first flow path 201 in the Y direction. A discharge defect such as the nozzle 21 being clogged by the thickened ink or a deviation in the flying direction of discharged ink droplets is likely to occur due to the thickened ink staying in the vicinity of the nozzle 21.

In the embodiment, since the nozzle 21 communicates with a portion in the middle of the first flow path 201 having a cross-sectional area smaller than that of the second flow path 202, during the circulation of the ink, it is possible to increase the flow speed of the ink flowing through the first flow path 201 directly above the nozzle 21, and thus the ink flowing through the first flow path 201 enables the ink, which is thickened by the nozzle 21, to easily flow to the second common liquid chamber 102 in the downstream region. Therefore, the thickened ink has a reduced possibility of staying in the vicinity of the nozzle 21, and thus it is possible to prevent the occurrence of a defect in discharging ink droplets.

In addition, since the nozzle 21 communicates with a portion in the middle of the first flow path 201 extending in the Y direction, air bubbles infiltrating from the nozzle 21 are capable of flowing to the second common liquid chamber 102 in the downstream region by virtue of the ink flowing through the first flow path 201. Therefore, air bubbles infiltrating from the nozzle 21 are prevented from entering the pressure chamber 12 or the first common liquid chamber 101, and thus it is possible to prevent a defect in discharging ink droplets, which is caused due to a fluctuation in the pressure of the ink in the pressure chamber 12 being absorbed by air bubbles that infiltrate the pressure chamber 12. By the way, if the nozzle 21 is provided at a position to communicate with the second flow path 202, air bubbles infiltrating from the nozzle 21 are likely to move to the pressure chamber 12 against the flow of the ink due to the buoyancy of the air bubbles. If air bubbles infiltrate the pressure chamber 12 from the nozzle 21, the air bubbles infiltrating the pressure chamber 12 absorb a fluctuation in the pressure of the ink in the pressure chamber 12, and a defect in discharging ink droplets occurs, which is a concern.

In the embodiment, since the nozzle 21 communicates with a portion in the middle of the first flow path 201 having a cross-sectional area smaller than that of the second flow path 202, during the circulation of the ink, it is possible to increase the flow speed of the ink flowing through the first flow path 201 directly above the nozzle 21, and thus air bubbles infiltrating from the nozzle 21 are capable of easily flowing to the second common liquid chamber 102 in the downstream region by virtue of the ink flowing through the first flow path 201. Particularly, even though air bubbles rise upward due to buoyancy, since no air bubbles move to the pressure chamber 12 against the flow of the ink, it is possible to reduce air bubbles infiltrating the pressure chamber 12. Therefore, it is possible to prevent the occurrence of a defect in discharging ink droplets, which is caused by air bubbles.

By the way, for example, it is possible to consider also a configuration where the nozzle 21 is provided at a position to communicate with the second flow path 202, and the flow speed of a portion of the second flow path 202 which is close to the nozzle 21 is increased by making the cross-sectional area of the portion of the second flow path 202 which is close to the nozzle 21 smaller than the cross-sectional area of a portion close to the pressure chamber 12, and thus the thickened ink flows downstream. However, even in the configuration described above, air bubbles infiltrating from the nozzle 21 infiltrate the pressure chamber 12 against the flow of the ink due to the buoyancy of the air bubbles, which is a concern. In the embodiment, since the extending direction of the first flow path 201, in the middle of which the nozzle 21 communicates with a portion, is a direction intersecting the Z direction which is a vertical direction, it is possible to prevent air bubbles from infiltrating the pressure chamber 12.

Incidentally, preferably, the nozzle 21 of the embodiment is disposed in the first flow path 201 at a position close to the second flow path 202. Herein, the position close to the second flow path 202 implies that in the first flow path 201, a distance from the nozzle 21 to the second flow path 202 is shorter than a distance from the nozzle 21 to a flow path opposite to the second flow path 202, in the embodiment, to the second common liquid chamber 102. As described above, if the nozzle 21 is disposed at a position close to the second flow path 202, an increase in pressure loss from the pressure chamber 12 to the nozzle 21 is prevented, and thus it is possible to prevent a deterioration in the discharge characteristics of ink droplets, particularly, a decrease in the weight of ink droplets. Namely, since the cross-sectional area of the first flow path 201 is smaller than the cross-sectional area of the second flow path 202, if the distance in the first flow path 201 from the second flow path 202 to the nozzle 21 becomes long, a flow path resistance from the pressure chamber 12 to the nozzle 21 is increased. If the nozzle 21 communicates with the first flow path 201 at a position which is in the middle of the first flow path 201 and is close to the second flow path 202, since it is possible to reduce the flow path resistance from the pressure chamber 12 to the nozzle 21, a pressure loss when ink droplets are discharged from the nozzle 21 by driving the piezoelectric actuator 300 is reduced, and thus it is possible to prevent a deterioration in the discharge characteristics of ink droplets.

Incidentally, in the embodiment, the first flow path 201 and the second common liquid chamber 102 of the individual flow path 200 are directly coupled to each other; however, the present disclosure is not specifically limited to the configuration. Another flow path may be provided between the first flow path 201 and the second common liquid chamber 102. For example, if another flow path is provided between the first flow path 201 and the second common liquid chamber 102, preferably, the distance in the first flow path 201 from the nozzle 21 to the second flow path 202 is shorter than a distance in the first flow path 201 from the nozzle 21 to the other flow path.

In addition, preferably, the flow path resistance from the nozzle 21 to the pressure chamber 12 is smaller than the flow path resistance from the nozzle 21 to the second common liquid chamber 102, and the inertance between the pressure chamber 12 and the nozzle 21 of the individual flow path 200 is smaller than the inertance between the nozzle 21 and the second common liquid chamber 102. Namely, preferably, the flow path resistances of a portion upstream of the position where the first flow path 201 communicates with the nozzle 21, and the second flow path 202 are smaller than the flow path resistance of a portion downstream region of the position where the first flow path 201 communicates with the nozzle 21. Preferably, the inertance of the portion upstream of the position where the first flow path 201 communicates with the nozzle 21, and the second flow path 202 is smaller than the inertance of the portion downstream of the position where the first flow path 201 communicates with the nozzle 21. Accordingly, it is possible to dispose the nozzle 21 at a position close to the second flow path 202, and thus it is possible to prevent a remarkable decrease in the weight of ink droplets to be discharged from the nozzle 21, and it is possible to improve discharge efficiency.

In addition, as illustrated in FIG. 3, a portion in the first flow path 201, in which a line L connecting positions where the flow speed of the ink flowing through the first flow path 201 becomes the maximum is the closest to the nozzle plate 20 in the Z direction, is positioned in the nozzle 21 in the plan view from the Z direction. Namely, since the ink flowing from the second flow path 202 to the first flow path 201 is curved at the right angle, the line L connecting the positions where the flow speed of the ink flowing through the first flow path 201 becomes the maximum swells in an end portion of the first flow path 201, which is close to the second flow path 202, so as to be close to the nozzle 21. If the nozzle 21 is disposed at a position to overlap a portion $L_1$ of the line L which is the closest to the nozzle plate 20 in the Z direction, it is possible to bring the nozzle 21 close to the portion L1 in which the flow speed of the ink flowing through the first flow path 201 is high, and the thickened ink in the nozzle 21 is capable of effectively flowing toward the second common liquid chamber 102 in the downstream region. Therefore, the thickened ink is prevented from staying in the nozzle 21, and thus it is possible to prevent a discharge defect such as the nozzle 21 being clogged by the thickened ink or a deviation in the flying direction of discharged ink droplets.

In addition, as illustrated in FIG. 4, preferably, in the first flow path 201, a width $w_1$ in the ink flow direction, namely, in the X direction which is the direction where the nozzles 21 are arranged side by side in a plan view from the Y direction is smaller than a height $h_1$ in the Z direction. Namely, preferably, $w_1<h_1$ is satisfied. For example, preferably, the ratio of the width $w_1$ in the X direction to the height $h_1$ in the Z direction in the first flow path 201, namely, $w_1:h_1=1:1.2$ to 3. As described above, if the width $w_1$ of the first flow path 201 in the X direction is made relatively narrow, it is possible to dispose the first flow paths 201 at a high density in the X direction, and it is possible to dispose the nozzles 21 at a high density.

In addition, as illustrated in FIG. 5, preferably, in the first flow path 201, a width $w_1'$ in the ink flow direction, namely, in the X direction which is the direction where the nozzles 21 are arranged side by side in the plan view from the Y direction is larger than a height $h_1'$ in the Z direction. Namely, preferably, $w_1'>h_1'$ is satisfied. For example, preferably, the ratio of the width $w_1'$ in the X direction to the height $h_1'$ in the Z direction in the first flow path 201, namely, $w_1':h_1'=1.01$ to 7:1. As described above, if the width $w_1'$ in the X direction is made larger than the height $h_1'$ in the Z direction in the first flow path 201, it is possible to bring the position, at which the flow speed of the ink flowing through the first flow path 201 becomes the maximum, to the nozzle plate 20, and the ink dried and thickened by the nozzle 21 or air bubbles suctioned from the nozzle 21 are capable of effectively flowing to the second common liquid chamber 102 in the downstream region by virtue of the ink flowing through the first flow path 201. Namely, since the ink is capable of flowing at a relatively high flow speed in the vicinity of the nozzle 21, the thickened ink in the nozzle 21 or air bubbles are capable of flowing downstream by virtue of the ink flowing through the first flow path 201.

Furthermore, in the plan view from the Y direction which is the direction where the ink flows through the first flow path 201, the width $w_1$ of the first flow path 201 in the X direction which is the direction where the nozzles 21 are arranged side by side may be smaller than a width $w_2$ of the second flow path 202. As described above, also with the manner where the width $w_1$ of the first flow path 201 is made narrower than the width $w_2$ of the second flow path 202, it is possible to make the cross-sectional area of the first flow path 201 smaller than the cross-sectional area of the second flow path 202, and it is possible to increase the flow speed of the ink flowing through the first flow path 201 directly above the nozzle 21.

In addition, for example, if an ink having a high viscosity, for example, a viscosity of 20 mPa·s to 100 mPa·s is used, since it is difficult to increase the flow speed of the ink, it is difficult for the ink dried and thickened by the nozzle 21 to flow toward the second common liquid chamber 102. However, as in the embodiment, if the cross-sectional area of the first flow path 201 communicating with the nozzle 21 is made smaller than the cross-sectional area of the second flow path 202, even with the ink having a high viscosity, it is possible to increase the flow speed of the ink flowing the first flow path 201. Therefore, the ink dried and thickened by the nozzle 21 is capable of effectively flowing to the second common liquid chamber 102 by virtue of the ink flowing through the first flow path 201 at a high flow speed.

As described above, the ink jet type recording head 1 which is one example of the liquid ejecting head of the embodiment includes a flow path substrate which includes the nozzle plate 20 and in which a flow path is formed, and the piezoelectric actuator 300 which is an energy generating element for inducing a change in the pressure of an ink which is a liquid in the flow path. The flow path includes the first common liquid chamber 101; the second common liquid chamber 102; and the plurality of individual flow paths 200 which communicate with the first common liquid chamber 101 and the second common liquid chamber 102 and through which the ink flows from the first common liquid chamber 101 toward the second common liquid chamber 102. The individual flow path 200 includes the nozzle 21 that communicates with the outside; the first flow path 201, in the middle of which the nozzle 21 is disposed and which extends in the Y direction that is the first direction which is the in-plane direction of the nozzle surface 20*a* of the nozzle plate 20 in which the nozzle 21 opens; the second flow path 202 that is coupled to the first flow path 201 and extends in the Z direction which is the second direction other than the Y direction; the third flow path that is coupled to the second flow path 202 and extends in the Y direction which is the third direction other than the Z direction; and the pressure chamber 12 which is disposed in the third flow path and in which a pressure change is induced by the piezoelectric actuator 300. The cross-sectional area of the first flow path 201 is smaller than the cross-sectional area of the second flow path 202.

As described above, if the nozzle 21 communicates with a portion in the middle of the first flow path 201 having a cross-sectional area smaller than that of the second flow path 202, the ink dried and thickened by the nozzle 21 or air bubbles infiltrating from the nozzle 21 are capable of flowing to the second common liquid chamber 102 in the downstream region by virtue of the ink flowing through the first flow path 201 at a high flow speed. Therefore, the thickened ink or the air bubbles are prevented from staying in the nozzle 21 and in the vicinity of the nozzle 21, and thus it is possible to prevent the occurrence of a discharge defect such as the nozzle 21 being clogged by the thickened ink or a deviation in the flying direction of ink droplets discharged from the nozzle 21. In addition, air bubbles are prevented from infiltrating the pressure chamber 12, and thus it is possible to prevent the occurrence of a defect in discharging ink droplets.

Incidentally, the individual flow path 200 of the embodiment is a flow path through which the ink flows from the first common liquid chamber 101 to the second common liquid chamber 102; however, the present disclosure is not specifically limited to the configuration. The individual flow path 200 may be a flow path through which the ink flows from the second common liquid chamber 102 to the first common liquid chamber 101. Namely, the individual flow path 200 may have the first flow path 201, the nozzle 21, the second flow path 202, the pressure chamber 12, and the supply path 203 in the order from an upstream region communicating with the second common liquid chamber 102 toward a downstream region communicating with the first common liquid chamber 101. Namely, in the individual flow path 200, the nozzle 21 and the pressure chamber 12 may be disposed in the order from the upstream region toward the downstream region with respect to the flow of the ink from the second common liquid chamber 102 toward the first common liquid chamber 101. In the configuration described above, when ink droplets are not discharged, the ink flows from the second common liquid chamber 102 to the first common liquid chamber 101 through the individual flow path 200. In addition, in order to discharge ink droplets, when a change in the pressure of the ink in the pressure chamber 12 is induced by driving the piezoelectric actuator 300, and the internal pressure of the nozzle 21 is increased, ink droplets are discharged from the nozzle 21 to the outside. By the way, the discharge of ink droplets from the nozzle 21 is determined by the pressure of the ink in the nozzle 21. The pressure of the ink in the nozzle 21 is determined by the pressure of the ink flowing from the second common liquid chamber 102 toward the first common liquid chamber 101, namely, a so-called circulation pressure, and the pressure of the ink that flows from the pressure chamber 12 toward the nozzle 21 due to the piezoelectric actuator 300 being driven.

In addition, in the recording head 1 of the embodiment, preferably, the nozzle 21 is disposed in the first flow path 201 at a position close to the second flow path 202. As described above, if the nozzle 21 is disposed at a position close to the second flow path 202, an increase in pressure loss from the pressure chamber 12 to the nozzle 21 is prevented, and thus it is possible to prevent a deterioration in the discharge characteristics of ink droplets, particularly, a decrease in the weight of ink droplets.

In addition, in the recording head 1 of the embodiment, preferably, the flow path resistance between the pressure chamber 12 and the nozzle 21 of the individual flow path 200 is smaller than the flow path resistance between the nozzle 21 and the second common liquid chamber 102, and the inertance between the pressure chamber 12 and the nozzle 21 of the individual flow path 200 is smaller than the inertance between the nozzle and the second common liquid chamber. As described above, if the flow path resistance between the pressure chamber 12 and the nozzle 21 is made smaller than the flow path resistance between the nozzle 21 and the second common liquid chamber 102, and the inertance between the pressure chamber 12 and the nozzle 21 is made smaller than the inertance between the nozzle 21 and the second common liquid chamber 102, since it is possible to dispose the nozzle 21 at a position close to the second flow path 202, it is possible to prevent a remarkable decrease in the weight of ink droplets to be discharged from the nozzle 21, and it is possible to improve discharge efficiency.

In addition, in the recording head 1 of the embodiment, preferably, a portion in the first flow path 201, in which the line L connecting the positions where the flow speed of the ink as a liquid flowing through the first flow path 201 becomes the maximum is the closest to the nozzle plate 20, is positioned in the nozzle 21 in the plan view from the Z direction which is the normal direction of the nozzle surface 20*a*. According to this, since it is possible to bring the nozzle 21 close to the portion L1 in which the flow speed of the ink flowing through the first flow path 201 is high, the thickened ink in the nozzle 21 is capable of effectively flowing toward the second common liquid chamber 102 in the downstream region.

In addition, in the recording head 1 of the embodiment, preferably, in the plan view from the Y direction which is the direction where the ink as a liquid flows through the first flow path 201, the width $w_1$ of the first flow path 201 in the X direction which is the direction where the nozzles 21 are arranged side by side is smaller than the height $h_1$ of the first flow path 201 in the Z direction which is the normal direction of the nozzle surface 20*a*. As described above, if the width $w_1$ of the first flow path 201 in the X direction is made relatively narrow, it is possible to dispose the first flow paths 201 at a high density in the X direction, and it is possible to dispose the nozzles 21 at a high density.

In addition, in the recording head 1 of the embodiment, preferably, in the plan view from the Y direction which is the direction where the ink as a liquid flows through the first flow path 201, the width $w_1'$ of the first flow path 201 in the X direction which is the direction where the nozzles 21 are arranged side by side is larger than the height $h_1'$ of the first flow path 201 in the Z direction which is the normal direction of the nozzle surface 20*a*. According to this, since it is possible to bring the position, at which the flow speed of the ink flowing through the first flow path 201 becomes the maximum, to the nozzle plate 20, the ink dried and thickened by the nozzle 21 or air bubbles suctioned from the nozzle 21 are capable of effectively flowing to the second common liquid chamber 102 positioned downstream by virtue of the ink flowing through the first flow path 201.

In addition, in the recording head 1 of the embodiment, preferably, in the plan view from the direction where the ink as a liquid flows through the first flow path 201, the width $w_1$ of the first flow path 201 in the X direction which is the direction where the nozzles 21 are arranged side by side is smaller than the width $w_2$ of the second flow path 202. As described above, also with the manner where the width $w_1$ of the first flow path 201 is made narrower than the width $w_2$ of the second flow path 202, it is possible to make the cross-sectional area of the first flow path 201 smaller than the cross-sectional area of the second flow path 202, and it is possible to increase the flow speed of the ink flowing through the first flow path 201 directly above the nozzle 21.

In addition, in the recording head 1 of the embodiment, preferably, the nozzle 21 has the first hole 21*a* and the second hole 21*b* which have different inner diameters, and the first hole 21*a* and the second hole 21*b* are formed side by side in the Z direction which is the normal direction of the nozzle surface of the nozzle plate 20.

As described above, if the nozzle 21 is provided with the first hole 21*a* having a relatively small inner diameter, it is possible to improve the flow speed of the ink and the discharge speed of ink droplets to be discharged. In addition, since the nozzle 21 is provided with the second hole 21*b* having a relatively large inner diameter, when the ink flows through the individual flow path 200 from the first common liquid chamber 101 toward the second common liquid chamber 102, namely, when so-called circulation is performed, it is possible to reduce a portion that is not influenced by the flow of circulation. Therefore, it is possible to easily remove the ink thickened by the nozzle 21.

In addition, in the recording head 1 of the embodiment, preferably, the viscosity of the ink which is a liquid is greater than or equal to 20 mPa·s. Even with an ink having a high viscosity, the flow speed of which is difficult to increase, it is possible to increase the flow speed of the ink flowing through the first flow path 201, and the ink dried and thickened by the nozzle 21 is capable of effectively flowing to the second common liquid chamber 102 by virtue of the ink flowing through the first flow path 201 at a high flow speed.

In addition, in the recording head 1 of the embodiment, preferably, the thickness of the nozzle plate 20 is from 60 μm to 100 μm. According to this, it is possible to improve the handleability of the nozzle plate 20, and to improve the ease to manufacture the nozzle plate 20 and the ease to assemble the recording head 1.

Incidentally, the embodiment employs a configuration where the nozzle plate 20 and the compliance substrate 49 are provided as separate bodies; however, the present disclosure is not limited to the configuration. For example, the nozzle plate 20 may be provided having a size to cover the opening of the first common liquid chamber 101, and the compliance portion 494 may be provided in part of the nozzle plate 20. The nozzle plate 20 provided with the compliance portion 494 as described above can be manufactured of a resin film such as a polyimide film or a metallic material such as stainless steel.

Embodiment 2

Figure 6:
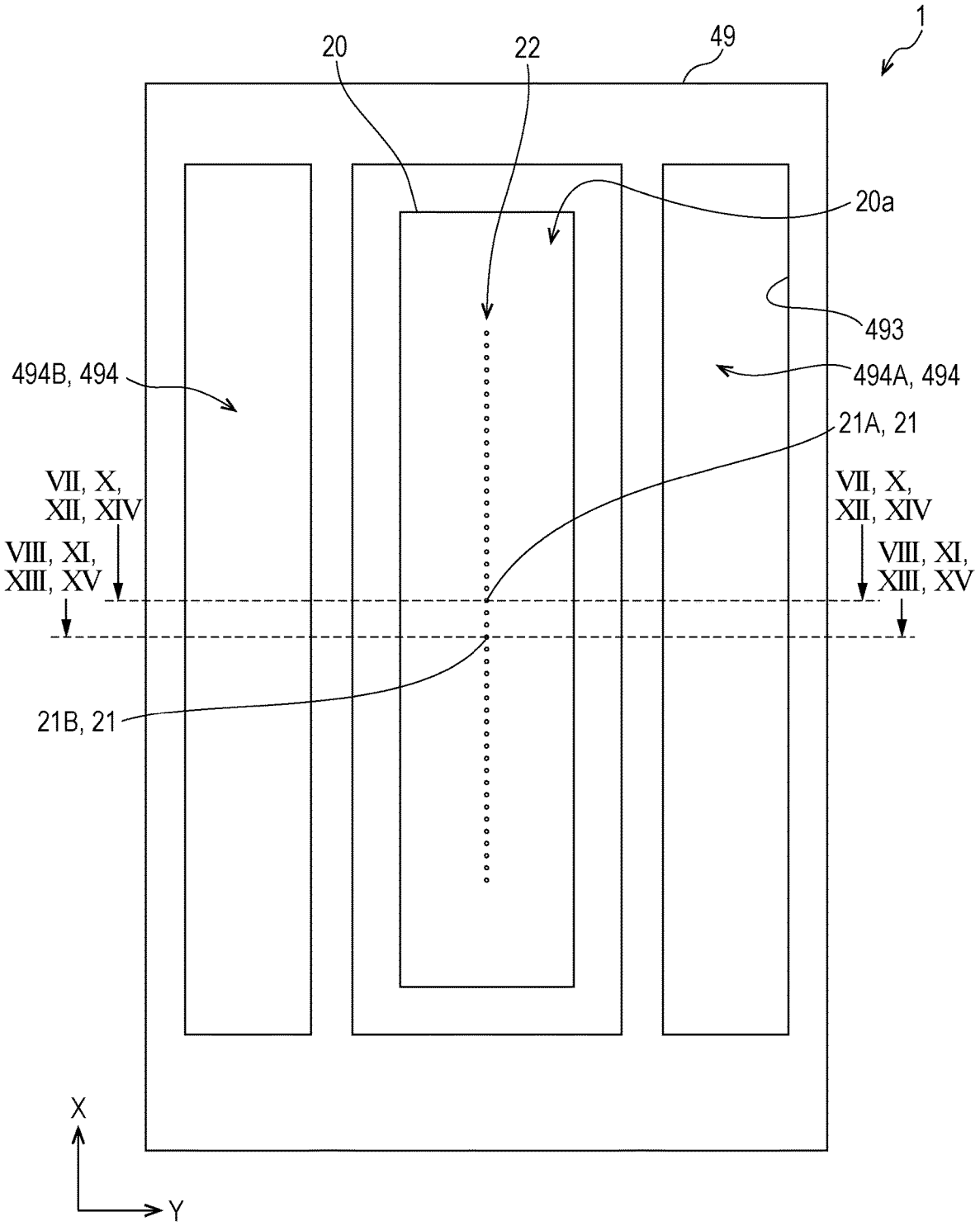
FIG. 6 is a plan view of a recording head according to Embodiment 2 of the present disclosure.
Figure 7:
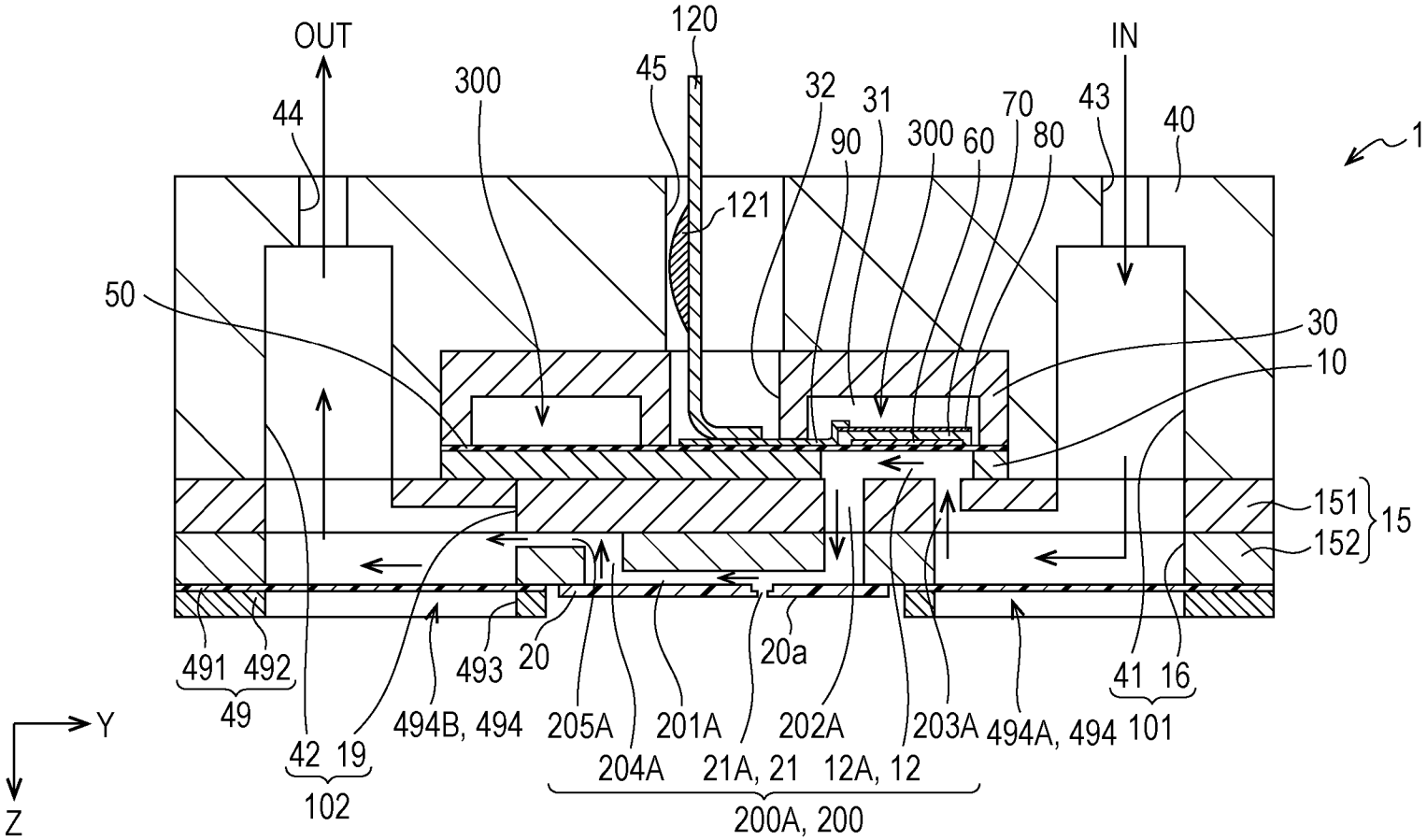
FIG. 7 is a cross-sectional view of the recording head according to Embodiment 2 of the present disclosure.
Figure 8:
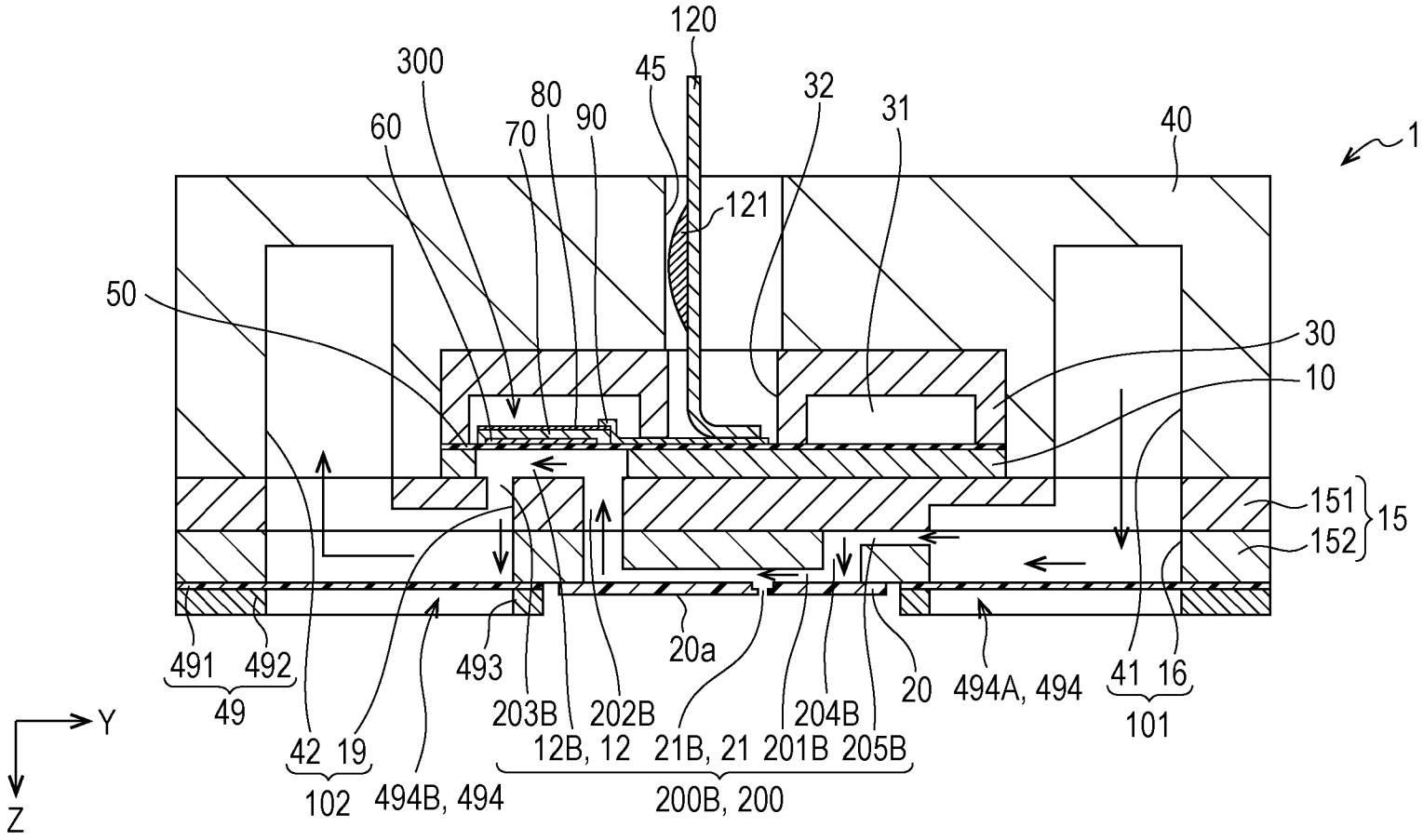
FIG. 8 is a cross-sectional view of the recording head according to Embodiment 2 of the present disclosure.
Figure 9:
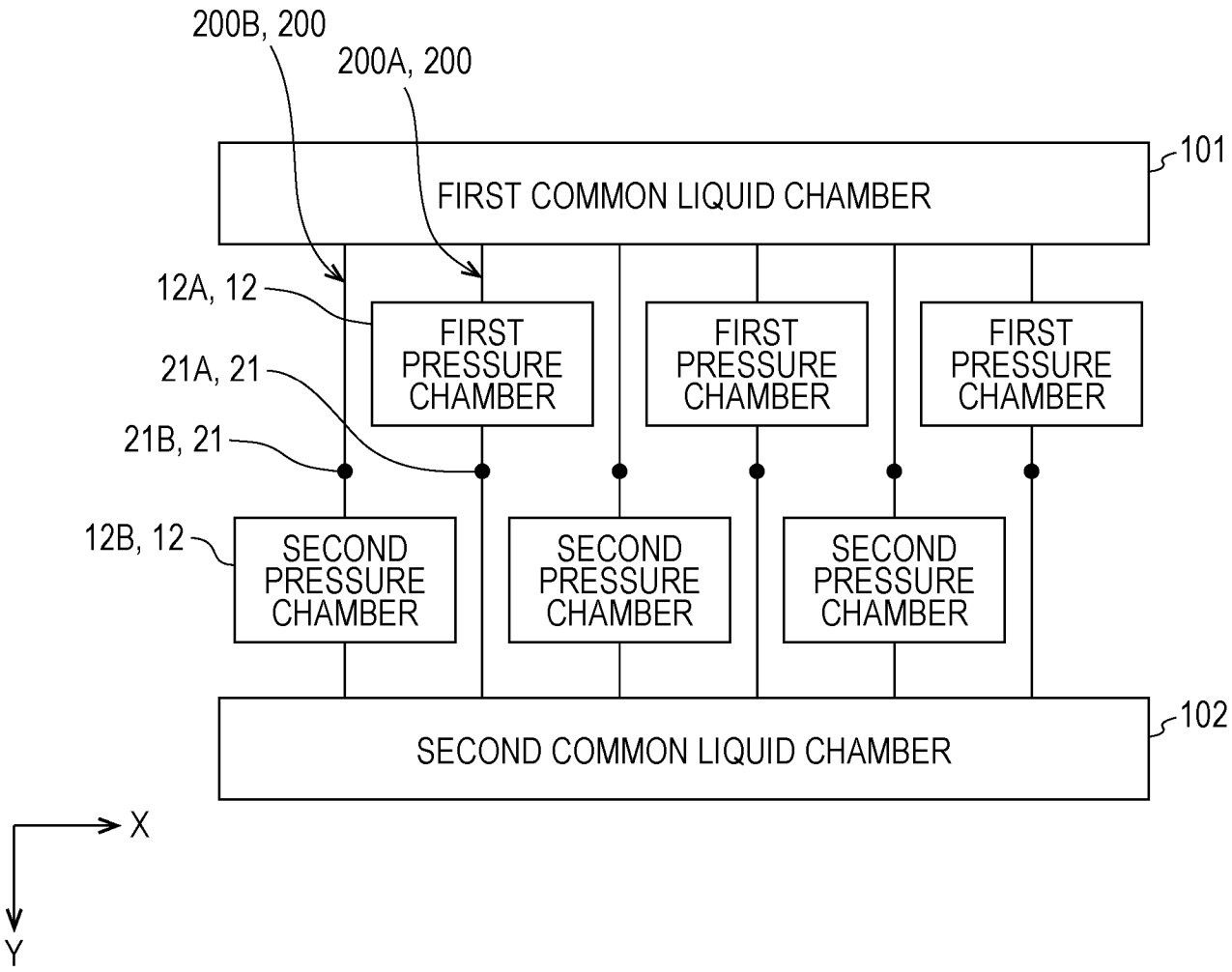
FIG. 9 is a diagram schematically illustrating flow paths according to Embodiment 2 of the present disclosure.

FIG. 6 is a plan view of an ink jet type recording head which is one example of a recording head according to Embodiment 2 of the present disclosure. FIG. 7 is a cross-sectional view taken along a line VII-VII in FIG. 6. FIG. 8 is a cross-sectional view taken along a line VIII-VIII in FIG. 6. FIG. 9 is a diagram schematically illustrating a flow path configuration according to Embodiment 2. Incidentally, the same reference signs are assigned to the same members as those in the embodiment described above, and the duplicated description will be omitted.

As illustrated in FIGS. 7 and 8, the flow path formation substrate 10, the communication plate 15, the nozzle plate 20, the compliance substrate 49, the case member 40, and the like which are flow path substrates are provided with the first common liquid chamber 101, the second common liquid chamber 102, and a plurality of the individual flow paths 200 through which an ink flows from the first common liquid chamber 101 to the second common liquid chamber 102.

Two rows of the pressure chambers 12 which are arranged side by side in the X direction are arranged side by side in the flow path formation substrate 10 in the Y direction. In addition, in two rows of the pressure chambers 12, the pressure chamber 12 in one row is referred to as a first pressure chamber 12A, and the pressure chamber 12 in the other row is referred to as a second pressure chamber 12B. The first pressure chamber 12A and the second pressure chamber 12B are disposed at positions which do not overlap each other in a plan view from the X direction. In addition, the first pressure chambers 12A and the second pressure chambers 12B are disposed in a so-called staggered pattern where the first pressure chambers 12A deviate from the second pressure chamber 12B in the X direction. In the embodiment, the row in which the first pressure chambers 12A are arranged side by side in the X direction, and the row in which the second pressure chambers 12B are arranged side by side in the X direction are disposed at positions which deviate by half a pitch from each other in the X direction.

In addition, in the embodiment, the nozzle 21 communicating with the first pressure chamber 12A is referred to as a first nozzle 21A, and the nozzle 21 communicating with the second pressure chamber 12B is referred to as a second nozzle 21B. In the embodiment, as illustrated in FIG. 6, the first nozzle 21A and the second nozzle 21B are alternately disposed in the X direction. In addition, in the embodiment, the first nozzle 21A and the second nozzle 21B are disposed at the same position in the Y direction. Namely, the nozzles 21 are disposed on a straight line along the X direction.

In addition, as illustrated in FIGS. 7 and 8, the communication plate 15 is provided with the first communication portion 16 forming part of the first common liquid chamber 101, and a fourth communication portion 19 forming part of the second common liquid chamber 102. Since the first communication portion 16 is the same as that in the Embodiment 1, the duplicated description will be omitted.

The fourth communication portion 19 is provided at a position to overlap the second liquid chamber portion 42 of the case member 40 in the Z direction, and opens in both of the +Z and −Z side surfaces of the communication plate 15, namely, is provided to penetrate the communication plate 15 in the Z direction. The fourth communication portion 19 communicates with the second liquid chamber portion 42 on the −Z side to form the second common liquid chamber 102. Namely, the second common liquid chamber 102 is formed of the second liquid chamber portion 42 of the case member 40 and the fourth communication portion 19 of the communication plate 15. In addition, the fourth communication portion 19 extends on the +Z side in the Y direction to a position to overlap the second pressure chamber 12B in the Z direction.

In addition, the compliance substrate 49 is provided on an open surface of the second common liquid chamber 102 on the +Z side, and part of a wall surface of the second common liquid chamber 102 becomes the compliance portion 494. In the embodiment, the compliance portion 494 provided in the first common liquid chamber 101 is referred to as a first compliance portion 494A, and the compliance portion 494 provided in the second common liquid chamber 102 is referred to as a second compliance portion 494B. As described above, if the compliance portion 494 is provided in part of the wall surface of each of the first common liquid chamber 101 and the second common liquid chamber 102, the compliance portion 494 is capable of, by being deformed, absorbing a fluctuation in the pressure of the ink in the first common liquid chamber 101 and the second common liquid chamber 102.

By the way, if the second compliance portion 494B is not provided and only the first compliance portion 494A is provided, a pressure fluctuation when ink droplets are discharged in an individual flow path which is provided with the pressure chamber 12 and the nozzle 21 is transmitted to another individual flow path via the second common liquid chamber 102, and thus the discharge characteristics of ink droplets discharged from the other individual flow path are not stable, and there occur variations in the discharge characteristics of ink droplets discharged from the plurality of nozzles 21, which is a concern. Similarly, if the first compliance portion 494A is not provided and only the second compliance portion 494B is provided, a pressure fluctuation of the individual flow path is transmitted via the first common liquid chamber 101, and there occur variations in the discharge characteristics of ink droplets, which is a concern. In the embodiment, since the compliance portions are provided in both of the first common liquid chamber 101 and the second common liquid chamber 102, it is difficult for a pressure fluctuation of an individual flow path to be transmitted to another individual flow path via the first common liquid chamber 101 and the second common liquid chamber 102, and it is possible to prevent the occurrence of variations in the discharge characteristics of ink droplets.

In addition, if the second compliance portion 494B is not provided and only the first compliance portion 494A is provided, when ink droplets are discharged from a small number of the nozzles 21, the ink is sufficiently supplied to the pressure chambers 12 by the deformation of the first compliance portions 494A. However, when ink droplets are simultaneously discharged from a large number of the nozzles 21, the ink is not sufficiently supplied to the pressure chambers 12 only by the deformation of the first compliance portions 494A, and depending on the number of the nozzles 21 that simultaneously discharge the ink, there occur variations in the discharge characteristics of ink droplets, particularly, in the weight of ink droplets, which is a concern. In the embodiment, since both of the first compliance portion 494A and the second compliance portion 494B are provided, the occurrence of a shortage of ink supply to the pressure chamber 12 is prevented which is caused by the number of the nozzles 21 that simultaneously discharge ink droplets, and thus it is possible to prevent the occurrence of variations in the discharge characteristics of ink droplets.

In addition, as described above, if the compliance portion 494 is provided on both of the first common liquid chamber 101 and the second common liquid chamber 102, in the embodiment, since the first common liquid chamber 101 and the second common liquid chamber 102 are provided so as to open on the +Z side on which the nozzle 21 opens, the nozzle plate 20 and the compliance portion 494 are disposed on the +Z side which is the same side with respect to the individual flow path 200 having the pressure chamber 12 and the nozzle 21 in the Z direction which is the normal direction of the nozzle surface 20*a*. As described above, if the compliance portion 494 is disposed on the same side as the nozzle 21 with respect to the individual flow path 200, it is possible to provide the compliance portion 494 in a region where the nozzle 21 is not provided, and it is possible to provide the compliance portion 494 having a relatively wide area. In addition, if the compliance portion 494 and the nozzle 21 are disposed on the same side with respect to the individual flow path 200, the compliance portion 494 is disposed at a position close to the individual flow path 200, and thus the compliance portion 494 is capable of effectively absorbing a fluctuation in the pressure of the ink in the individual flow path 200.

Incidentally, the position of the compliance portion 494 is not specifically limited to the position, and the compliance portion 494 may be disposed opposite to the nozzle 21 with respect to the individual flow path 200 in the Z direction. Namely, it is also possible to provide the compliance portion 494 on a −Z side surface of the case member 40, side surfaces of the case member 40 and the communication plate 15, or the like. However, as described above, since the compliance portion 494 is disposed on the same +Z side as the nozzle 21, the compliance portion 494 is disposed at a position close to the individual flow path 200, and thus the compliance portion 494 is capable of effectively absorbing a fluctuation in the pressure of the ink in the individual flow path 200, and the compliance portion 494 can be formed having a relatively wide area.

In addition, two compliance portions 494 of the embodiment are provided, as illustrated in FIG. 6, in one compliance substrate 49. Naturally, the compliance substrate 49 is not limited to the configuration, and the compliance substrate 49 may be independently provided for each of the compliance portions 494.

In addition, the individual flow path 200 of the embodiment includes a first individual flow path 200A having the first nozzle 21A, and a second individual flow path 200B having the second nozzle 21B. The first individual flow path 200A and the second individual flow path 200B are alternately disposed in the X direction.

Herein, as illustrated in FIG. 7, the first individual flow path 200A includes the first nozzle 21A; the first pressure chamber 12A; a first flow path 201A; a second flow path 202A; a first supply path 203A; a fourth flow path 204A; and a fifth flow path 205A.

The first supply path 203A is a flow path through which the first pressure chamber 12A communicates with the first common liquid chamber 101, and is provided penetrating the first communication plate 151 in the Z direction, namely, extends along the Z direction.

The first pressure chamber 12A forms the third flow path that extends in the direction other than the Z direction. The third flow path of the first individual flow path 200A of the embodiment is formed only of the first pressure chamber 12A. The first pressure chamber 12A is, as described above, provided in the flow path formation substrate 10. In addition, the first pressure chamber 12A forms a first resolution in the X direction which is a direction where the flow paths are arranged. Incidentally, since the first pressure chamber 12A and the second pressure chamber 12B are disposed at different positions in the Y direction, the first resolution is the resolution of each of the first pressure chamber 12A and the second pressure chamber 12B. In addition, the first resolution is a pitch of the flow paths in the X direction which is the direction where the flow paths are arranged.

Similar to Embodiment 1 described above, the first flow path 201A extends between the nozzle plate 20 and the communication plate 15 in the Y direction which is the first direction. The first flow path 201A of the embodiment is formed by providing a recessed portion in the second communication plate 152 and covering an opening of the recessed portion with the nozzle plate 20. Incidentally, the first flow path 201A is not specifically limited to being formed by the method, and may be formed by providing a recessed portion in the nozzle plate 20 and covering the recessed portion of the nozzle plate 20 with the second communication plate 152, or may be formed by providing recessed portions in both of the second communication plate 152 and the nozzle plate 20, respectively. The first nozzle 21A is disposed in the middle of the first flow path 201A so as to communicate therewith.

Similar to Embodiment 1 described above, the second flow path 202A is coupled to the first flow path 201A, and extends in the second direction, in the embodiment, extends in the Z direction other than the Y direction which is the first direction where the first flow path 201A extends. The second flow path 202A is provided to penetrate the communication plate 15 in the Z direction, communicates with the first pressure chamber 12A at one end in the Z direction, and communicates with the first flow path 201A at the other end in the Z direction.

The fourth flow path 204A is provided to penetrate the second communication plate 152 in the third direction such that one end of the fourth flow path 204A communicates with the first flow path 201A and the other end communicates with the fifth flow path 205A. Namely, the fourth flow path 204A extends in the Z direction different from the Y direction which is the first direction where the first flow path 201A extends.

The fifth flow path 205A extends between the first communication plate 151 and the second communication plate 152 along the Y direction in the in-plane direction of the nozzle surface 20*a* such that one end of the fifth flow path 205A communicates with the fourth flow path 204A and the other end communicates with the second common liquid chamber 102. The fifth flow path 205A of the embodiment is formed by providing a recessed portion in the second communication plate 152 and covering the recessed portion with the first communication plate 151. Naturally, the fifth flow path 205A may be formed by providing a recessed portion in the first communication plate 151 and covering the recessed portion with the second communication plate 152, or may be formed by providing recessed portions in both of the first communication plate 151 and the second communication plate 152, respectively.

The first individual flow path 200A described above has the first supply path 203A, the first pressure chamber 12A, the second flow path 202A, the first flow path 201A, the first nozzle 21A, the fourth flow path 204A, and the fifth flow path 205A in the order from an upstream region communicating with the first common liquid chamber 101 toward a downstream region communicating with the second common liquid chamber 102. Namely, in the embodiment, as illustrated in FIG. 9, in the first individual flow path 200A, the first pressure chamber 12A and the first nozzle 21A are disposed in the order from the upstream region toward the downstream region with respect to the flow of the ink from the first common liquid chamber 101 toward the second common liquid chamber 102.

In the first individual flow path 200A described above, when ink droplets are not discharged, the ink flows from the first common liquid chamber 101 to the second common liquid chamber 102 through the first individual flow path 200A. In addition, in order to discharge ink droplets, when a change in the pressure of the ink in the first pressure chamber 12A is induced by driving the piezoelectric actuator 300, and the internal pressure of the first nozzle 21A is increased, ink droplets are discharged from the first nozzle 21A to the outside.

Incidentally, in the embodiment, in the first individual flow path 200A, flow paths upstream of the first nozzle 21A, namely, a portion of the first flow path 201A which is closer to the second flow path 202A than the first nozzle 21A, the second flow path 202A, the first pressure chamber 12A, and the first supply path 203A are referred to as first upstream flow paths. In addition, in the first individual flow path 200A, flow paths downstream of the first nozzle 21A, namely, a portion of the first flow path 201A which is closer to the fourth flow path 204A than the first nozzle 21A, the fourth flow path 204A, and the fifth flow path 205A are referred to as first downstream flow paths.

As illustrated in FIG. 8, the second individual flow path 200B includes the second nozzle 21B; the second pressure chamber 12B; a first flow path 201B; a second flow path 202B; a second supply path 203B; a fourth flow path 204B; and a fifth flow path 205B.

The second supply path 203B is a flow path through which the second pressure chamber 12B communicates with the second common liquid chamber 102, and is provided penetrating the first communication plate 151 in the Z direction, namely, extends along the Z direction.

The second pressure chamber 12B forms the third flow path that extends in the direction other than the Z direction. The third flow path of the second individual flow path 200B of the embodiment is formed only of the second pressure chamber 12B. The second pressure chamber 12B is, as described above, provided in the flow path formation substrate 10. In addition, the second pressure chamber 12B is disposed at a position that is different from the position of the first pressure chamber 12A of the first individual flow path 200A in the Y direction. The first pressure chamber 12A and the second pressure chamber 12B are provided at positions which do not overlap each other in the plan view from the X direction. Similar to the first pressure chamber 12A, the second pressure chamber 12B described above is formed with the first resolution in the X direction.

In addition, the second pressure chamber 12B and the fifth flow path 205A of the first individual flow path 200A are disposed at different positions in the Z direction which is the normal direction of the nozzle surface 20*a*. Specifically, the second pressure chamber 12B is provided close to the −Z side with respect to the first communication plate 151, and the fifth flow path 205A is provided close to the +Z side with respect to the first communication plate 151. The second pressure chamber 12B and the fifth flow path 205A are disposed at the different positions in the Z direction. For this reason, even though the second pressure chamber 12B and the fifth flow path 205A are disposed proximate to each other in the X direction, the thickness of a partition wall partitioning the second pressure chamber 12B is prevented from being reduced, and thus it is possible to prevent the occurrence of variations in discharge characteristics, which is caused due to a pressure being absorbed by the deformation of the partition wall of the second pressure chamber 12B. In addition, even though the second pressure chamber 12B and the fifth flow path 205A are disposed such that at least parts of the second pressure chamber 12B and the fifth flow path 205A overlap each other in the plan view from the Z direction, since the second pressure chamber 12B and the fifth flow path 205A are disposed at the different positions in the Z direction, the second pressure chamber 12B and the fifth flow path 205A do not communicate with each other.

Similar to Embodiment 1 described above, the first flow path 201B extends between the nozzle plate 20 and the communication plate 15 in the Y direction which is the first direction. The first flow path 201B of the embodiment is formed by providing a recessed portion in the second communication plate 152 and covering an opening of the recessed portion with the nozzle plate 20. Incidentally, the first flow path 201B is not specifically limited to being formed by the method, and may be formed by providing a recessed portion in the nozzle plate 20 and covering the recessed portion of the nozzle plate 20 with the second communication plate 152, or may be formed by providing recessed portions in both of the second communication plate 152 and the nozzle plate 20, respectively.

The first flow path 201A of the first individual flow path 200A and the first flow path 201B of the second individual flow path 200B are alternately disposed between the communication plate 15 and the nozzle plate 20 in the X direction. A resolution defined by alternately disposing the first flow path 201A and first flow path 201B in the X direction is referred to as a second resolution. The second resolution of the first flow path 201A and the first flow path 201B is larger than the first resolution of the first pressure chamber 12A or the second pressure chamber 12B. For example, if the first pressure chamber 12A is formed with the first resolution of 300 dpi and the second pressure chamber 12B is formed with the first resolution of 300 dpi, the first flow path 201A and the first flow path 201B are formed with the second resolution of 600 dpi. Therefore, if the first resolution of each of the first pressure chamber 12A and the second pressure chamber 12B is set smaller than the second resolution of the first flow path 201A and the first flow path 201B, it is possible to widen the opening widths of the first pressure chamber 12A and the second pressure chamber 12B in the X direction, and it is possible to increase the excluded volume of the pressure chamber 12.

The second nozzle 21B is disposed in the middle of the first flow path 201B so as to communicate therewith. The second nozzle 21B is disposed at the same position as the position of the first nozzle 21A in the Y direction, namely, at a position where the first nozzle 21A and the second nozzle 21B overlap each other in the plan view from the X direction.

Similar to Embodiment 1 described above, the second flow path 202B is coupled to the first flow path 201B, and extends in the second direction, in the embodiment, extends in the Z direction other than the Y direction which is the first direction where the first flow path 201B extends. The second flow path 202B is provided to penetrate the communication plate 15 in the Z direction, communicates with the second pressure chamber 12B at one end in the Z direction, and communicates with the first flow path 201B at the other end in the Z direction.

The fourth flow path 204B is provided to penetrate the second communication plate 152 in the third direction such that one end of the fourth flow path 204B communicates with the first flow path 201B and the other end communicates with the fifth flow path 205B. Namely, the fourth flow path 204B extends in the Z direction different from the Y direction which is the first direction where the first flow path 201B extends.

The fifth flow path 205B extends between the first communication plate 151 and the second communication plate 152 along the Y direction in the in-plane direction of the nozzle surface 20*a* such that one end of the fifth flow path 205B communicates with the fourth flow path 204B and the other end communicates with the second common liquid chamber 102. The fifth flow path 205B of the embodiment is formed by providing a recessed portion in the second communication plate 152 and covering the recessed portion with the first communication plate 151. Naturally, the fifth flow path 205B may be formed by providing a recessed portion in the first communication plate 151 and covering the recessed portion with the second communication plate 152, or may be formed by providing recessed portions in both of the first communication plate 151 and the second communication plate 152, respectively.

The fifth flow path 205B of the second individual flow path 200B described above and the first pressure chamber 12A of the first individual flow path 200A are disposed at different positions in the Z direction which is the normal direction of the nozzle surface 20*a*. Specifically, the first pressure chamber 12A is provided close to the −Z side with respect to the first communication plate 151, and the fifth flow path 205B is provided close to the +Z side with respect to the first communication plate 151. The first pressure chamber 12A and the fifth flow path 205B are disposed at the different positions in the Z direction. For this reason, even though the first pressure chamber 12A and the fifth flow path 205B are disposed proximate to each other in the X direction, the thickness of a partition wall partitioning the first pressure chamber 12A is prevented from being reduced, and the partition wall of the first pressure chamber 12A is prevented from, by being deformed, absorbing the pressure of the ink in the first pressure chamber 12A, and thus it is possible to prevent the occurrence of variations in discharge characteristics. In addition, even though the first pressure chamber 12A and the fifth flow path 205B are disposed such that at least parts of the first pressure chamber 12A and the fifth flow path 205B overlap each other in the plan view from the Z direction, since the first pressure chamber 12A and the fifth flow path 205B are disposed at the different positions in the Z direction, the first pressure chamber 12A and the fifth flow path 205B do not communicate with each other.

The second individual flow path 200B described above has the fifth flow path 205B, the fourth flow path 204B, the first flow path 201B, the second nozzle 21B, the second flow path 202B, the second pressure chamber 12B, and the second supply path 203B in the order from the upstream region communicating with the first common liquid chamber 101 toward the downstream region communicating with the second common liquid chamber 102. Namely, in the embodiment, as illustrated in FIG. 9, in the second individual flow path 200B, the second nozzle 21B and the second pressure chamber 12B are disposed in the order from the upstream region toward the downstream region with respect to the flow of the ink from the first common liquid chamber 101 toward the second common liquid chamber 102. Namely, the order of disposition of the pressure chamber 12 and the nozzle 21 differs between the first individual flow path 200A and the second individual flow path 200B with respect to the flow of the ink from the first common liquid chamber 101 toward the second common liquid chamber 102. In the embodiment, since each of the individual flow paths 200 is provided with one pressure chamber 12 and one nozzle 21, the order of disposition of the pressure chamber 12 and the nozzle 21 is reversed between the first individual flow path 200A and the second individual flow path 200B.

In the second individual flow path 200B described above, the ink flows from the first common liquid chamber 101 to the second common liquid chamber 102 through the second individual flow path 200B. In addition, a change in the pressure of the ink in the second pressure chamber 12B is induced by driving the piezoelectric actuator 300, and ink droplets are discharged from the second nozzle 21B to the outside by increasing the internal pressure of the second nozzle 21B. When the ink flows from the first common liquid chamber 101 to the second common liquid chamber 102 through the second individual flow path 200B, the piezoelectric actuator 300 may be driven, and when the ink does not flow from the first common liquid chamber 101 to the second common liquid chamber 102 through the second individual flow path 200B, the piezoelectric actuator 300 may be driven. In addition, the ink may temporarily flow from the second common liquid chamber 102 to the first common liquid chamber 101 due to a pressure change induced by driving the piezoelectric actuator 300. By the way, the discharge of ink droplets from the second nozzle 21B is determined by the pressure of the ink in the second nozzle 21B. The pressure of the ink in the second nozzle 21B is determined by the pressure of the ink flowing from the first common liquid chamber 101 toward the second common liquid chamber 102, namely, a so-called circulation pressure and the pressure of the ink that flows from the second pressure chamber 12B toward the second nozzle 21B due to the piezoelectric actuator 300 being driven.

For example, with respect to the flow of the ink from the first common liquid chamber 101 toward the second common liquid chamber 102, due to a fluctuation in the pressure of the ink in the second pressure chamber 12B, the ink may flow backward from the second pressure chamber 12B toward the second nozzle 21B, and ink droplets may be discharged from the second nozzle 21B. As described above, the fact that the ink flows backward from the second pressure chamber 12B toward the second nozzle 21B implies that the pressure of circulation from the first common liquid chamber 101 toward the second common liquid chamber 102 is low, and thus it is possible to reduce a pressure loss of the individual flow path 200 by reducing the pressure of circulation to a relatively low pressure. If the pressure loss of each of the individual flow paths 200 is reduced, since it is possible to reduce a difference in pressure loss between the individual flow paths 200, it is possible to reduce variations in the discharge characteristics of ink droplets to be discharged from each of the nozzles 21.

In addition, for example, with respect to the flow of the ink from the first common liquid chamber 101 toward the second common liquid chamber 102, due to a fluctuation in the pressure of the ink in the second pressure chamber 12B, the ink may be discharged from the second nozzle 21B without the backflow of the ink from the second pressure chamber 12B toward the second nozzle 21B. In this case, since the flow of the ink from the second pressure chamber 12B toward the second nozzle 21B is not formed, it is difficult for air bubbles to flow backward from the second pressure chamber 12B toward the second nozzle 21B, and it is difficult for air bubbles to cause a defect in discharging ink droplets from the second nozzle 21B.

Incidentally, in the embodiment, in the second individual flow path 200B, flow paths upstream of the second nozzle 21B, namely, a portion of the first flow path 201B which is closer to the fourth flow path 204B than the second nozzle 21B, the fourth flow path 204B, and the fifth flow path 205B are referred to as second upstream flow paths. In addition, in the embodiment, in the second individual flow path 200B, flow paths downstream of the second nozzle 21B, namely, a portion of the first flow path 201B which is closer to the second flow path 202B than the second nozzle 21B, the second flow path 202B, the second pressure chamber 12B, and the second supply path 203B are referred to as second downstream flow paths.

The first individual flow path 200A and the second individual flow path 200B described above are, as illustrated in FIG. 9, alternately provided in the X direction. Namely, regardless of the positions of the pressure chamber 12 and the nozzle 21 with respect to the flow of the ink from the first common liquid chamber 101 toward the second common liquid chamber 102, it is possible to discharge ink droplets from the nozzle 21 due to a fluctuation in the internal pressure of the pressure chamber 12. Namely, even though as in the first individual flow path 200A, the first pressure chamber 12A is disposed upstream and the first nozzle 21A is disposed downstream, and even though as in the second individual flow path 200B, the second nozzle 21B is disposed upstream and the second pressure chamber 12B is disposed downstream, it is possible to selectively discharge ink droplets from both of the first nozzle 21A and the second nozzle 21B due to a fluctuation in the pressure of the ink in the pressure chamber 12. For this reason, as described above, if with respect to the flow of the ink from the first common liquid chamber 101 toward the second common liquid chamber 102, the first individual flow path 200A and the second individual flow path 200B between which the order of the pressure chamber 12 and the nozzle 21 differs are alternately disposed in the X direction, it is possible to change the position of the pressure chamber 12 between the first individual flow path 200A and the second individual flow path 200B, namely, to dispose the first pressure chamber 12A and the second pressure chamber 12B at different positions in the Y direction. Therefore, it is possible to form the pressure chamber 12 having a wide width in the X direction in each of the individual flow paths 200, and it is possible to dispose the pressure chambers 12 at a high density in the X direction. Namely, if the first pressure chamber 12A and the second pressure chamber 12B are disposed at the different positions in the Y direction, it is possible to thicken a partition wall between the first pressure chambers 12A that are arranged side by side in the X direction, and it is possible to thicken a partition wall between the second pressure chambers 12B that are arranged side by side in the X direction. Therefore, even though each of the first pressure chamber 12A and the second pressure chamber 12B is formed having a wide width in the X direction, it is possible to prevent a reduction in the rigidity of the partition wall, it is possible to improve the discharge characteristics of ink droplets, namely, to increase the weight of ink droplets by increasing the excluded volume, and it is possible to prevent the occurrence of cross talk caused by a reduction in the rigidity of the partition wall. In addition, even though the first pressure chambers 12A and the second pressure chambers 12B are disposed at a high density in the X direction, it is possible to prevent a reduction in the rigidity of the partition wall, and it is possible to prevent the occurrence of cross talk caused by a reduction in the rigidity of the partition wall.

By the way, for example, if the second individual flow path 200B is not provided and only the first individual flow paths 200A are arranged side by side in the X direction, when the first pressure chambers 12A are disposed at a high density in the X direction, the thickness of the partition wall between the first pressure chambers 12A adjacent to each other is reduced, and the rigidity of the partition wall is reduced. As described above, if the rigidity of the partition wall is reduced, cross talk occurs due to the deformation of the partition wall. Namely, if ink droplets are simultaneously discharged from the nozzles 21 on both sides of the nozzle 21 discharging ink droplets, pressures are applied, at the same timing, from both sides to the partition wall between the first pressure chambers 12A adjacent to each other. In this case, since pressures are applied from both sides to the partition wall, regardless of the rigidity of the partition wall, it is difficult for the partition wall to be deformed. On the other hand, if ink droplets are not discharged from the nozzles 21 on both sides of the nozzle 21 discharging ink droplets, a pressure is applied only to one side of the partition wall between the first pressure chambers 12A adjacent to each other. At that time, if the rigidity of the partition wall is low, the partition wall is deformed to absorb a pressure fluctuation, and the discharge characteristics of the ink droplets deteriorate. For this reason, variations in the discharge characteristics of ink droplets occur depending on a difference in condition such as which nozzle discharging ink droplets among the plurality of nozzles 21. Therefore, if only the first pressure chamber 12A is provided, it is not possible to form the first pressure chamber 12A having a wide width in the X direction, and it is not possible to dispose the first pressure chambers 12A at a high density in the X direction.

In the embodiment, since the first pressure chamber 12A and the second pressure chamber 12B are disposed at the different positions in the Y direction, it is possible to increase the thickness of the partition wall between the first pressure chambers 12A, which are adjacent to each other in the X direction, to a relatively large thickness, and it is possible to increase the thickness of the partition wall between the second pressure chambers 12B, which are adjacent to each other in the X direction, to a relatively large thickness. For this reason, even though each of the first pressure chamber 12A and the second pressure chamber 12B is formed having a wide width in the X direction, it is possible to prevent a reduction in the rigidity of the partition wall between the first pressure chambers 12A and in the rigidity of the partition wall between the second pressure chambers 12B. Therefore, it is possible to increase the volumes of the first pressure chamber 12A and the second pressure chamber 12B by preventing a size increase of the flow path substrate in the X direction, it is possible to improve the discharge characteristics of ink droplets, particularly, to increase the weight of ink droplets by increasing the excluded volume by the drive of the piezoelectric actuator 300, and it is possible to prevent the occurrence of cross talk caused by a reduction in the rigidity of the partition wall.

In addition, even though a gap between the first pressure chamber 12A and the second pressure chamber 12B in the X direction is shortened, since it is possible to prevent a reduction in the rigidity of the partition wall between the first pressure chambers 12A and in the rigidity of the partition wall between the second pressure chambers 12B, it is possible to dispose the first pressure chambers 12A and the second pressure chambers 12B at a high density in the X direction. Therefore, it is possible to attain a size reduction of the flow path substrate in the X direction and to improve the discharge characteristics of ink droplets by increasing the excluded volume of the pressure chamber 12, it is possible to dispose the pressure chambers 12 at a high density in the X direction and to dispose the nozzles 21 at a high density, and it is possible to prevent the occurrence of cross talk caused by a reduction in the rigidity of the partition wall.

In addition, since it is possible to reduce the second resolution of the first flow path 201A and the first flow path 201B compared to the first resolution of the first pressure chamber 12A or the second pressure chamber 12B, it is possible to dispose the first nozzle 21A and the second nozzle 21B close to each other. Namely, since the nozzle 21 is disposed at a position in the middle of each of the first flow path 201A and the first flow path 201B, which extend in the in-plane direction of the nozzle surface 20*a*, so as to communicate therewith, even though the first pressure chamber 12A and the second pressure chamber 12B are disposed at different positions in the Y direction, it is possible to easily adjust the position of the nozzle 21 in the Y direction, and thus it is possible to dispose the plurality of nozzles 21 close to each other in the Y direction, and it is possible to easily dispose the plurality of nozzles 21 in one row on a straight line along the X direction.

In the configuration described above, in the plan view from the X direction which is the direction where the nozzles 21 are arranged side by side, in two individual flow paths adjacent to each other in the X direction, namely, in the first individual flow path 200A and the second individual flow path 200B, a gap between the nozzle 21, namely, a gap between the first nozzle 21A and the second nozzle 21B is smaller than a gap between the pressure chambers 12, namely, a gap between the first pressure chamber 12A and the second pressure chamber 12B.

As described above, if the gap between the first nozzle 21A and the second nozzle 21B is made smaller than the gap between the first pressure chamber 12A and the second pressure chamber 12B in the Y direction, it is possible to dispose the plurality of nozzles 21 close to each other at a high density, it is possible to dispose the first pressure chamber 12A and the second pressure chamber 12B at positions apart from each other in the Y direction, and it is possible to dispose a row of the first pressure chambers 12A and a row of the second pressure chambers 12B at a low density compared to the nozzle 21. Therefore, it is possible to attain a size reduction of the flow path substrate by increasing the excluded volume of each of the pressure chambers 12 or disposing the pressure chambers 12 at a high density.

In addition, if the plurality of nozzles 21 are disposed at the same position in the Y direction, it is not necessary to adjust the timing of discharging ink droplets from each of the nozzles 21 so as for the timings to deviate from each other, and it is possible to simplify control of the drive of the piezoelectric actuator 300. By the way, the reason is that when the recording head 1 moves in the Y direction and discharges ink droplets, if the ink droplets are discharged at the same timing from the nozzles 21 disposed at different positions in the Y direction, since the hitting positions of the ink droplets on an ejection target medium deviate from each other in the Y direction, it is necessary to adjust the drive timing of the piezoelectric actuator 300 so as for the ink droplets to hit the same position in the Y direction.

In addition, if the first nozzle 21A and the second nozzle 21B are disposed at positions which are relatively apart from each other in the Y direction, turbulent flows generated by ink droplets discharged from the first nozzle 21A and the second nozzle 21B influence each other, and there occurs a deviation in the flying direction of the ink droplets, which is a concern. As in the embodiment, if the first nozzle 21A and the second nozzle 21B are disposed at relatively close positions, it is possible to prevent turbulent flows from influencing ink droplets discharged from the nozzles 21, to prevent variations in the flying direction of the ink droplets, and to prevent a deviation in the hitting position of the ink droplets on the ejection target medium.

In addition, in the embodiment, the first nozzle 21A and the second nozzle 21B are disposed on a straight line along the X direction; however, the present disclosure is not specifically limited to the disposition. For example, if the first nozzle 21A and the second nozzle 21B communicate with portions in the middle of the first flow path 201A and the first flow path 201B, respectively, the first nozzle 21A and the second nozzle 21B may be disposed at deviated positions in the Y direction.

As described above, the ink jet type recording head 1 which is one example of the liquid ejecting head of the embodiment includes a flow path substrate which includes the nozzle plate 20 and in which a flow path is formed, and the piezoelectric actuator 300 which is an energy generating element for inducing a change in the pressure of an ink which is a liquid in the flow path. The flow path includes the first common liquid chamber 101; the second common liquid chamber 102; and the plurality of individual flow paths 200 which communicate with the first common liquid chamber 101 and the second common liquid chamber 102 and through which the ink flows from the first common liquid chamber 101 toward the second common liquid chamber 102. The individual flow path 200 includes the nozzle 21 that communicates with the outside; the first flow path 201, in the middle of which the nozzle 21 is disposed and which extends in the Y direction that is the first direction which is the in-plane direction of the nozzle surface 20*a* of the nozzle plate 20 in which the nozzle 21 opens; the second flow path 202 that is coupled to the first flow path 201 and extends in the Z direction which is the second direction other than the Y direction; the third flow path that is coupled to the second flow path 202 and extends in the Y direction which is the third direction other than the Z direction; and the pressure chamber 12 which is disposed in the third flow path and in which a pressure change is induced by the piezoelectric actuator 300. The cross-sectional area of the first flow path 201 is smaller than the cross-sectional area of the second flow path 202.

As described above, if the first nozzle 21A and the second nozzle 21B communicate with portions in the middle of the first flow path 201A and the first flow path 201B having cross-sectional areas smaller than those of the second flow path 202A and the second flow path 202B, respectively, the ink dried and thickened by the first nozzle 21A and the second nozzle 21B or air bubbles infiltrating from the first nozzle 21A and the second nozzle 21B are capable of flowing to the second common liquid chamber 102 in the downstream region by virtue of the ink flowing through the first flow path 201A and the first flow path 201B at a high flow speed. Therefore, the thickened ink or the air bubbles are prevented from staying in the first nozzle 21A and the second nozzle 21B and in the vicinities thereof, and thus it is possible to prevent the occurrence of a discharge defect such as the first nozzle 21A and the second nozzle 21B being clogged by the thickened ink or a deviation in the flying direction of ink droplets discharged from the first nozzle 21A and the second nozzle 21B.

In addition, in the recording head 1 of the embodiment, among the plurality of individual flow paths 200, three individual flow paths 200 adjacent to each other in the X direction which is the direction where the nozzles 21 are arranged side by side communicate with the first common liquid chamber 101 and the second common liquid chamber 102, and the arrangement order of the pressure chamber 12 and the nozzle 21 in the flow direction of the ink as a liquid from the first common liquid chamber 101 toward the second common liquid chamber 102 differs between the first individual flow path 200A and the second individual flow path 200B adjacent to each other in the X direction.

As described above, if the first individual flow path 200A and the second individual flow path 200B, which are individual flow paths 200 between which the arrangement order of the pressure chamber 12 and the nozzle 21 differs, are disposed so as to be adjacent to each other in the X direction, the pressure chambers 12 of the individual flow paths 200 adjacent to each other can be disposed at different positions in the Y direction. Therefore, compared to the case where the individual flow paths 200 between which the order of the pressure chamber 12 and the nozzle 21 is the same are arranged side by side, it is possible to increase the discharge weight of ink droplets by providing the pressure chamber 12 having a wide width in the direction where the nozzles 21 are arranged side by side and increasing the excluded volume of the pressure chamber 12 using the piezoelectric actuator 300, and it is possible to reduce the size of the flow path substrate by arranging the pressure chambers 12 side by side in the X direction at a high density. In addition, since the pressure chambers 12 of the individual flow paths 200 adjacent to each other can be disposed at deviated positions in the Y direction, the density where the pressure chambers 12 of the individual flow paths 200 adjacent to each other in the X direction are provided is improved, and thus it is possible to dispose the nozzles 21 at a high density.

In addition, since the individual flow paths 200 do not merge together at a location in the middle thereof, and the individual flow paths 200 communicate independently with the first common liquid chamber 101 and the second common liquid chamber 102, it is possible to prevent the occurrence of cross talk which is caused by the influence of a pressure fluctuation between the individual flow paths 200. Namely, if the individual flow paths 200 merge together before communicating with the first common liquid chamber 101 and the second common liquid chamber 102, a change in the pressure of the ink in one individual flow path 200 greatly influences the other individual flow path 200, and there occurs variations in ink discharge characteristics. In the embodiment, since the plurality of individual flow paths 200 communicate only with the first common liquid chamber 101 and the second common liquid chamber 102 which have a relatively large volume, it is possible to reduce the influence of a pressure fluctuation between the plurality of individual flow paths 200, and it is possible to prevent variations in ink discharge characteristics.

Furthermore, since the first common liquid chamber 101 communicate with the second common liquid chamber 102 only through the individual flow path 200, the ink in the first common liquid chamber 101 does not flow in the X direction which is the direction where the individual flow paths 200 are arranged side by side, a difference in the pressure of the ink to be supplied to the plurality of individual flow paths 200 is unlikely to occur, and variations in the discharge characteristics of the ink discharged from the nozzle 21 are unlikely to occur. By the way, if the ink flows through the first common liquid chamber 101 in the X direction, compared to the pressure of the ink supplied to the individual flow path 200 communicating with an upstream region of the first common liquid chamber 101, there occurs a decrease in the pressure of the ink supplied to the individual flow path 200 communicating with a downstream region, and thus variations in ink discharge characteristics are likely to occur due to variations in the pressure of the ink supplied to the individual flow paths 200.

Incidentally, in the embodiment, preferably, the individual flow path 200 is provided such that the flow path resistance of the upstream flow path closer to the first common liquid chamber 101 than the nozzle 21 is equal to the flow path resistance of the downstream flow path closer to the second common liquid chamber 102 than the nozzle 21.

Namely, the first upstream flow path and the first downstream flow path of the first individual flow path 200A have the same flow path resistance. Herein, the flow path resistance of the first upstream flow path and the first downstream flow path is determined by a flow path cross-sectional area, the flow path length, and the shape of the flow path.

In addition, the second upstream flow path and the second downstream flow path of the second individual flow path 200B have the same flow path resistance.

In the embodiment, the first individual flow path 200A and the second individual flow path 200B have shapes inverted with respect to an ink flow direction from the first common liquid chamber 101 toward the second common liquid chamber 102. Namely, the first upstream flow path of the first individual flow path 200A and the second downstream flow path of the second individual flow path 200B are provided so as to have the same shape and the same flow path resistance. The first downstream flow path of the first individual flow path 200A and the second upstream flow path of the second individual flow path 200B are provided so as to have the same shape and the same flow path resistance.

As described above, if the first upstream flow path and the first downstream flow path of the first individual flow path 200A have the same flow path resistance, and the second upstream flow path and the second downstream flow path of the second individual flow path 200B have the same flow path resistance, even though the first individual flow path 200A and the second individual flow path 200B have shapes inverted with respect to the ink flow direction from the first common liquid chamber 101 toward the second common liquid chamber 102, it is possible to equalize the flow path resistances of the first upstream flow path equal and the second upstream flow path from the first common liquid chamber to the nozzle 21. Therefore, it is possible to prevent the occurrence of variations in the discharge characteristics of ink droplets to be discharged from the first nozzle 21A of the first individual flow path 200A and in the discharge characteristics of ink droplets to be discharged from the second nozzle 21B of the second individual flow path 200B, and it is possible to simplify the structures of the flow paths.

In addition, if the flow path resistance of the first downstream flow path of the first individual flow path 200A is made equal to that of the second downstream flow path of the second individual flow path 200B, it is possible to equalize the discharge characteristics of ink droplets to be discharged from the nozzles 21. Namely, if ink droplets are simultaneously discharged from the plurality of nozzles 21, since the ink is supplied to the pressure chambers 12 from both of the first common liquid chamber 101 and the second common liquid chamber 102, it is possible to prevent the occurrence of variations in the amount of ink supply, and to prevent the occurrence of variations in the discharge characteristics of ink droplets by making the flow path resistance of the first downstream flow path equal to that of the second downstream flow path.

By the way, for example, if the flow path resistance of the first upstream flow path is different from that of the first downstream flow path in the first individual flow path 200A, when the second individual flow path 200B is formed by inverting the first individual flow path 200A, since the first downstream flow path of the first individual flow path 200A becomes the second upstream flow path of the second individual flow path 200B, the flow path resistances of the first upstream flow path and the second upstream flow path from the first common liquid chamber 101 to the nozzle 21 become different from each other. For this reason, there occur variations in the discharge characteristics of ink droplets to be discharged from the first nozzle 21A of the first individual flow path 200A and the second nozzle 21B of the second individual flow path 200B. In addition, in order to form the first upstream flow path and the second upstream flow path having the same flow path resistance, the second upstream flow path must be formed having a cross-sectional area, a flow path length, a shape, and the like different from those of the first downstream flow path, which causes complexity.

In addition, in a state where the ink flows from the first common liquid chamber 101 to the second common liquid chamber 102 via the individual flow paths 200, in a non-discharge period where ink droplets are not discharged from the nozzles 21, preferably, a difference of the internal ink pressure, relative to atmospheric pressure, of each of the nozzles 21 of the individual flow paths 200 adjacent to each other in the X direction which is the direction where the nozzles 21 are arranged side by side is from −2% to +2%. For example, if the atmospheric pressure is 1,013 hPa, the internal pressure of the nozzle 21 is approximately 1,000 hPa. Therefore, a difference in internal ink pressure between the nozzles 21 adjacent to each other is approximately a maximum of 20 hPa.

As described above, if in a non-discharge period, the difference in internal ink pressure between the first nozzle 21A and the second nozzle 21B which are adjacent to each other in the X direction is relatively small such as from −2% to +2%, it is possible to prevent the occurrence of variations in the discharge characteristics of ink droplets to be discharged from the first nozzle 21A and in the discharge characteristics of ink droplets to be discharged from the second nozzle 21B. As described above, in order to attain a relatively small difference in internal ink pressure between the first nozzle 21A and the second nozzle 21B, it is necessary to make the flow path resistance from the first common liquid chamber 101 to the first nozzle 21A equal to the flow path resistance from the first common liquid chamber 101 to the second nozzle 21B such that the difference in internal ink pressure between the nozzles 21 is from −2% to +2%. If the flow path resistance from the first common liquid chamber 101 to the first nozzle 21A and the flow path resistance from the first common liquid chamber 101 to the second nozzle 21B are formed such that the difference in internal ink pressure between the nozzles 21 is from −2% to +2%, since the first individual flow path 200A and the second individual flow path 200B have the same shape and the shapes inverted with respect to the ink flow direction, it is possible to simplify the structure of the individual flow path 200, and to dispose the first pressure chamber 12A and the second pressure chamber 12B at different positions in the Y direction.

In addition, the flow path resistance of the first upstream flow path and the first downstream flow path, the flow path resistance of the second upstream flow path and the second downstream flow path, or the difference in internal ink pressure between two nozzles 21 adjacent to each other in the X direction is not limited to that described above. For example, the flow path resistances of the first upstream flow path and the first downstream flow path, and the flow path resistances of the second upstream flow path and the second downstream flow path may be different from each other, or the pressure of the ink in the first nozzle 21A and the pressure of the ink in the second nozzle 21B may be less than −2% or greater than +2%. In the case described above, different voltages may be applied to the piezoelectric actuators 300 of the individual flow paths 200 adjacent to each other in the direction where the nozzles 21 are arranged side by side.

For example, if the first individual flow path 200A and the second individual flow path 200B have inverted structures, when the flow path resistance of the first upstream flow path is larger than that of the first downstream flow path, the pressure of the ink in the first nozzle 21A becomes low, and the weight of ink droplets to be discharged from the first nozzle 21A becomes small. On the other hand, if the first individual flow path 200A and the second individual flow path 200B have inverted structures, the flow path resistance of the second upstream flow path is smaller than the flow path resistance of the second downstream flow path, and the pressure of the ink in the second nozzle 21B becomes low. Therefore, the weight of ink droplets to be discharged from the second nozzle 21B becomes large. Therefore, a voltage to be applied to the piezoelectric actuator 300 corresponding to the first individual flow path 200A is made relatively higher than a voltage to be applied to the piezoelectric actuator 300 corresponding to the second individual flow path 200B. Incidentally, in order to make a voltage to be applied to the piezoelectric actuator 300 corresponding to the first individual flow path 200A relatively higher than a voltage to be applied to the piezoelectric actuator 300 corresponding to the second individual flow path 200B, for example, the voltage to be applied to the piezoelectric actuator 300 corresponding to the first individual flow path 200A may be made high, the voltage to be applied to the piezoelectric actuator 300 corresponding to the second individual flow path 200B may be made low, or both voltages may be adjusted with respect to a reference voltage. Accordingly, even though there occurs a relatively large difference in internal ink pressure between the first nozzle 21A and the second nozzle 21B, it is possible to reduce variations in the weight of ink droplets to be discharged from the first nozzle 21A and the second nozzle 21B, and to improve print quality by adjusting a voltage to be applied to the piezoelectric actuator 300.

Other Embodiments

The embodiments of the present disclosure are described above; however, basic configurations of the present disclosure are not limited to the configurations described above.

For example, in each of the embodiments described above, the configuration where one first common liquid chamber 101 and one second common liquid chamber 102 are provided in one flow path substrate is exemplified; however, the present disclosure is not specifically limited to the configuration.

Figure 10:
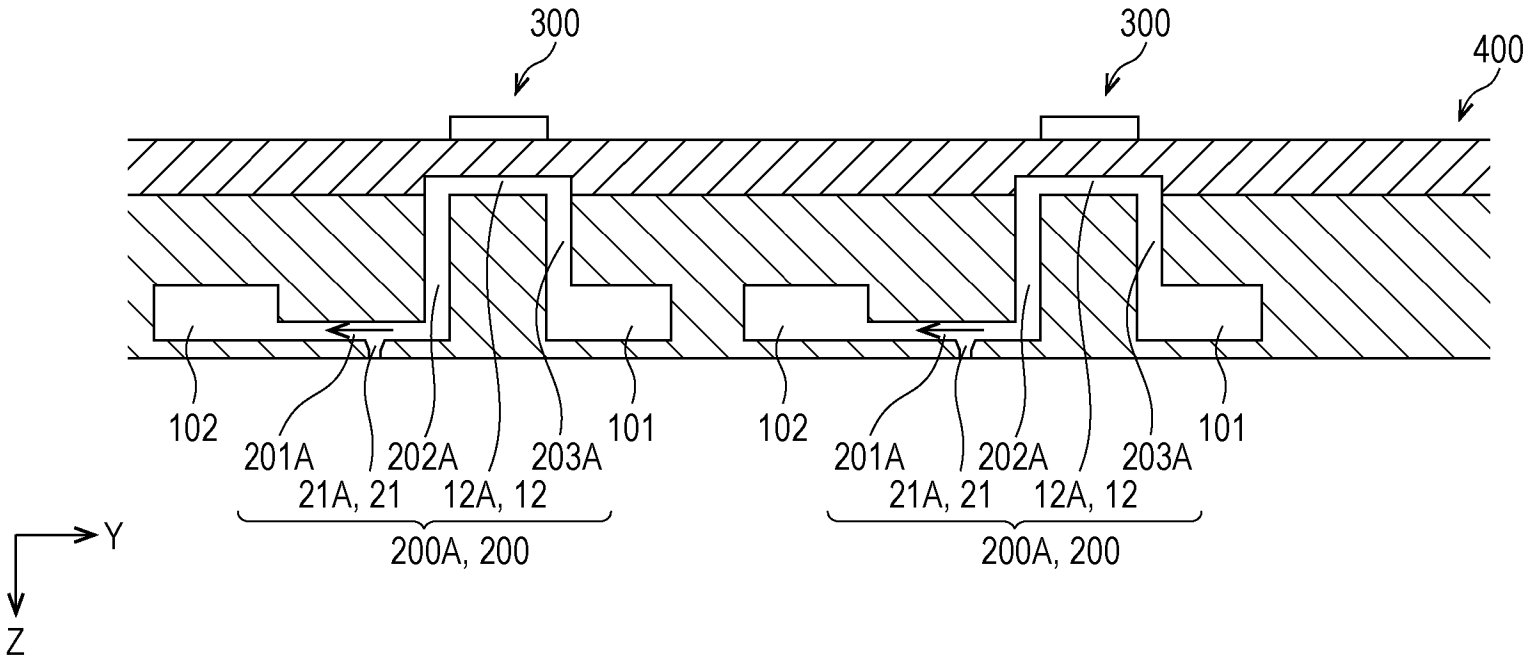
FIG. 10 is a cross-sectional view illustrating a recording head according to an embodiment of the present disclosure.
Figure 11:
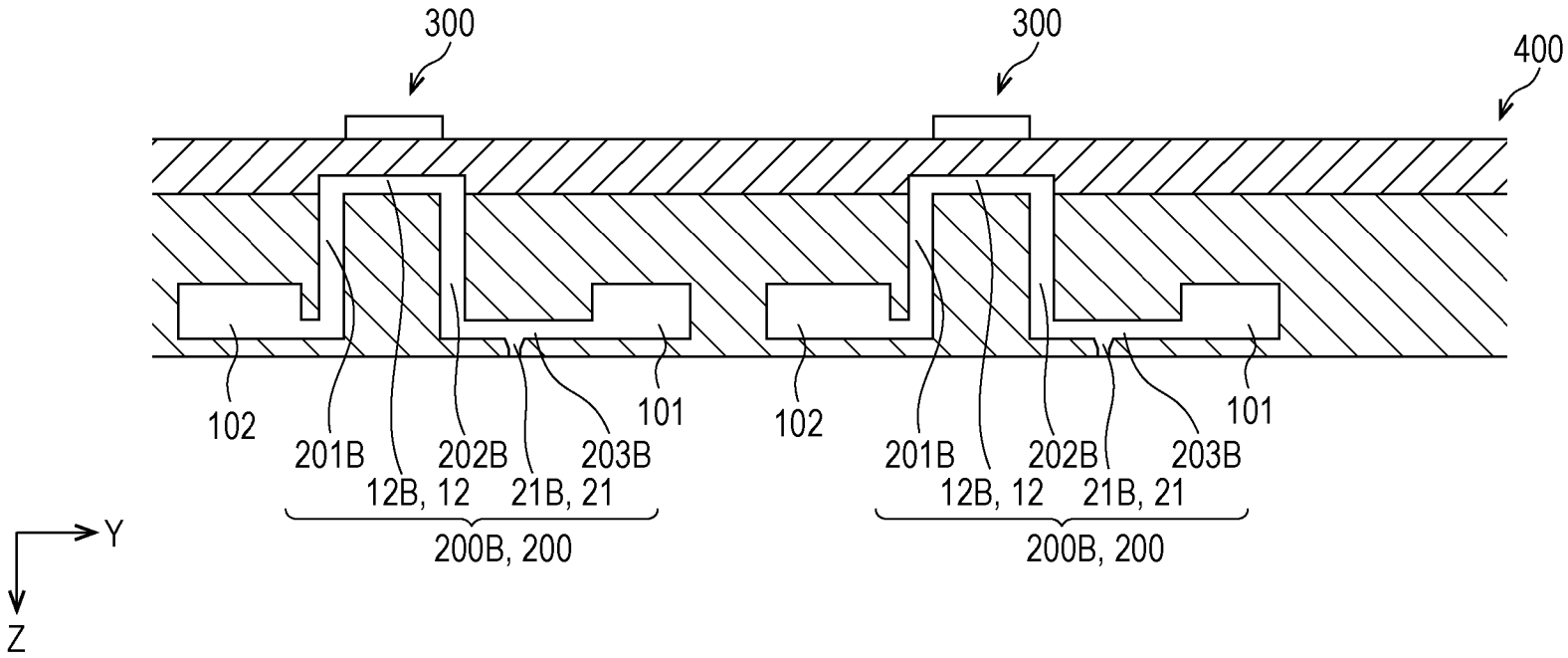
FIG. 11 is a cross-sectional view illustrating the recording head according to the embodiment of the present disclosure.

Herein, a modification example of the recording head 1 will be described with reference to FIGS. 10 and 11. Incidentally, FIG. 10 is a schematic cross-sectional view describing a flow path configuration which is taken along a line X-X in FIG. 6. FIG. 11 is a schematic cross-sectional view describing the flow path configuration which is taken along a line XI-XI in FIG. 6.

As illustrated in FIGS. 10 and 11, the first common liquid chamber 101 and the second common liquid chamber 102 are alternately and repeatedly disposed in a flow path substrate 400 in the Y direction. In addition, a plurality of the individual flow paths 200 are provided so as to supply an ink from the first common liquid chamber 101 to the second common liquid chamber 102. The plurality of individual flow paths 200 are provided along the X direction for one set of one first common liquid chamber 101 and one second common liquid chamber 102. The individual flow path 200 is positioned between the first common liquid chamber 101 and the second common liquid chamber 102 in the Y direction.

The individual flow path 200 has the first individual flow path 200A having the first nozzle 21A, and the second individual flow path 200B having the second nozzle 21B.

As illustrated in FIG. 10, the first individual flow path 200A includes the first nozzle 21A; the first pressure chamber 12A; the first flow path 201A; the second flow path 202A; and the first supply path 203A. The first nozzle 21A is provided in the middle of the first flow path 201A so as to communicate therewith.

The first individual flow path 200A described above has the first supply path 203A, the first pressure chamber 12A, the second flow path 202A, the first flow path 201A, and the first nozzle 21A in the order from an upstream region communicating with the first common liquid chamber 101 toward a downstream region communicating with the second common liquid chamber 102. Namely, in the embodiment, in the first individual flow path 200A, the first pressure chamber 12A and the first nozzle 21A are disposed in the order from the upstream region toward the downstream region with respect to the flow of the ink from the first common liquid chamber 101 toward the second common liquid chamber 102.

As illustrated in FIG. 11, the second individual flow path 200B includes the second nozzle 21B; the second pressure chamber 12B; the first flow path 201B; the second flow path 202B; and the second supply path 203B. The second nozzle 21B is provided in the middle of the first flow path 201B so as to communicate therewith.

The second individual flow path 200B described above has the first flow path 201B, the second nozzle 21B, the second flow path 202B, and the second supply path 203B in the order from the upstream region communicating with the first common liquid chamber 101 toward the downstream region communicating with the second common liquid chamber 102. Namely, in the embodiment, in the second individual flow path 200B, the second nozzle 21B and the second pressure chamber 12B are disposed in the order from the upstream region toward the downstream region with respect to the flow of the ink from the first common liquid chamber 101 toward the second common liquid chamber 102. Namely, the order of disposition of the pressure chamber 12 and the nozzle 21 differs between the first individual flow path 200A and the second individual flow path 200B with respect to the flow of the ink from the first common liquid chamber 101 toward the second common liquid chamber 102. In the embodiment, since each of the individual flow paths 200 is provided with one pressure chamber 12 and one nozzle 21, the order of disposition of the pressure chamber 12 and the nozzle 21 is reversed between the first individual flow path 200A and the second individual flow path 200B.

In the embodiment, the first nozzle 21A and the second nozzle 21B are arranged side by side on a straight line in the X direction. By the way, the first nozzle 21A and the second nozzle 21B may not be arranged side by side on a straight line in the X direction. In addition, FIGS. 10 and 11 illustrate only two sets of the first common liquid chamber 101 and the second common liquid chamber 102; however, three or more sets may be provided in the Y direction, or may be disposed in a so-called matrix pattern. In addition, the flexible cable 120 may be coupled in common to the piezoelectric actuators 300 corresponding to three or more sets of the first common liquid chamber 101 and the second common liquid chamber 102.

Figure 12:
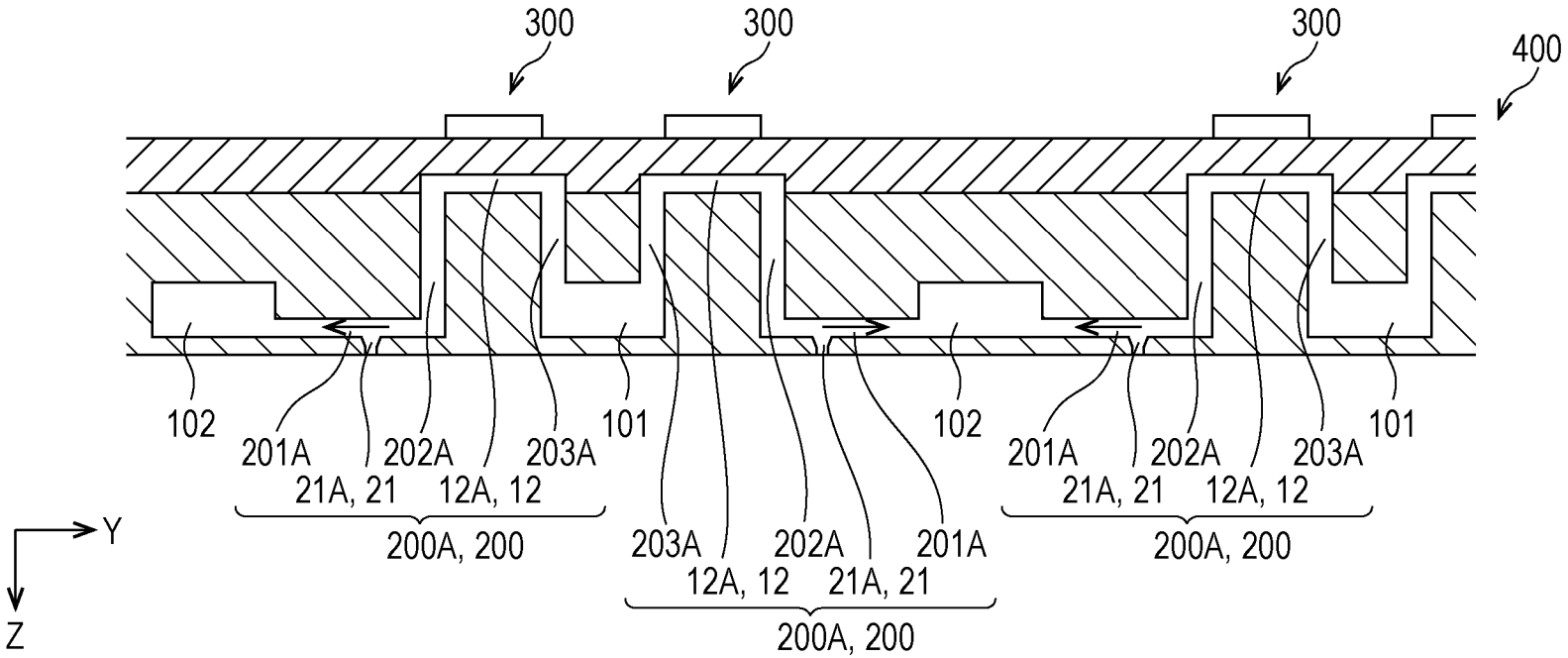
FIG. 12 is a cross-sectional view illustrating a recording head according to an embodiment of the present disclosure.
Figure 13:
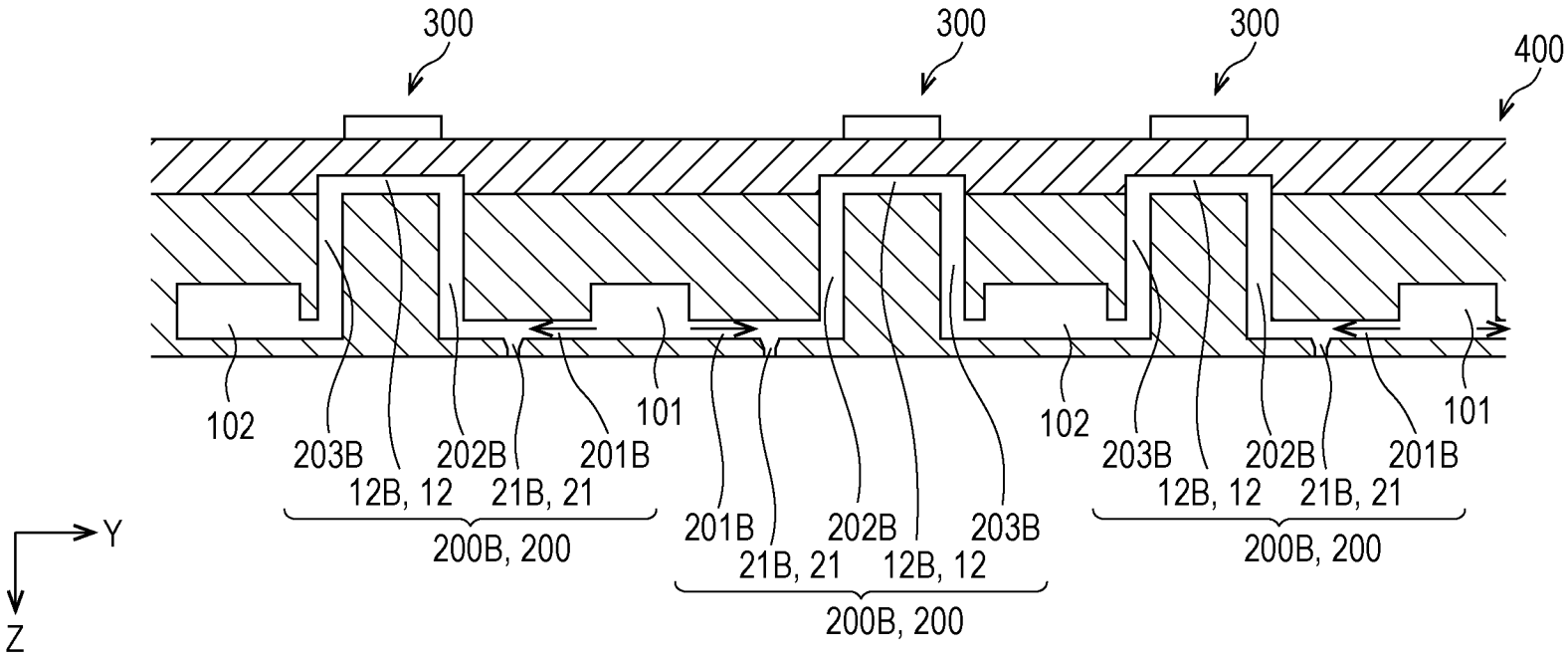
FIG. 13 is a cross-sectional view illustrating the recording head according to the embodiment of the present disclosure.

In addition, FIGS. 12 and 13 illustrate a modification example of the recording head 1 in FIGS. 10 and 11. Incidentally, FIG. 12 is a schematic cross-sectional view describing a flow path configuration which is taken along a line XII-XII in FIG. 6. FIG. 13 is a schematic cross-sectional view describing the flow path configuration which is taken along a line XIII-XIII in FIG. 6.

As illustrated in FIGS. 12 and 13, the first common liquid chamber 101 and the second common liquid chamber 102 are alternately disposed in the Y direction.

In addition, two rows of the individual flow paths 200 deliver the ink from one first common liquid chamber 101 to the second common liquid chambers 102 on both sides in the Y direction. In addition, two rows of the individual flow paths 200 deliver the ink from one second common liquid chamber 102 to the first common liquid chambers 101 on both sides in the Y direction. Namely, one first common liquid chamber 101 communicates with two rows of the individual flow paths 200, and one second common liquid chamber 102 communicates with two rows of the individual flow paths 200. As described above, since the first common liquid chamber 101 and the second common liquid chamber 102 are used for both of two rows of the individual flow paths 200, it is possible to attain a size reduction of the flow path substrate 400 by disposing the nozzles 21 at a high density.

Figure 14:
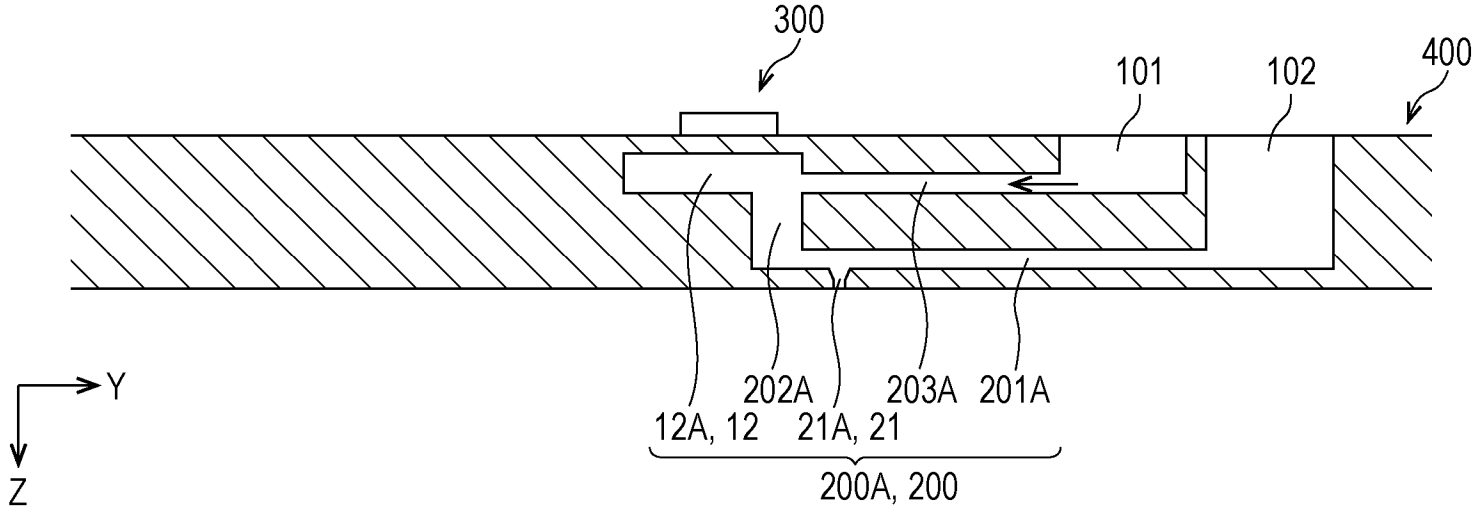
FIG. 14 is a cross-sectional view illustrating a recording head according to an embodiment of the present disclosure.
Figure 15:
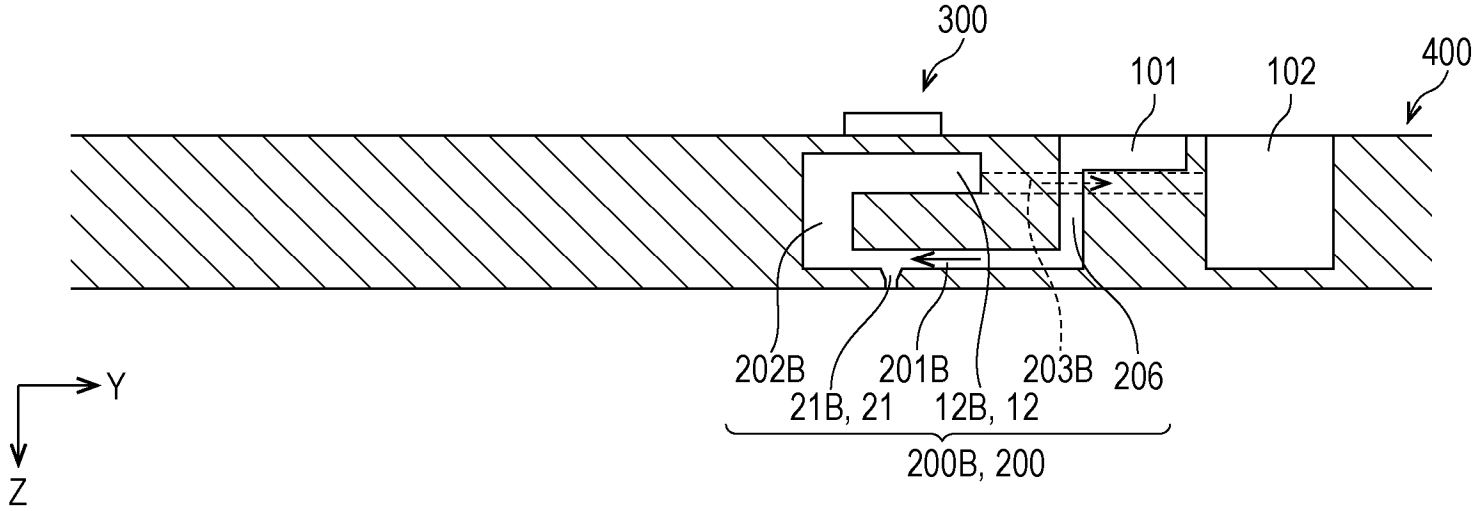
FIG. 15 is a cross-sectional view illustrating the recording head according to the embodiment of the present disclosure.
Figure 16:
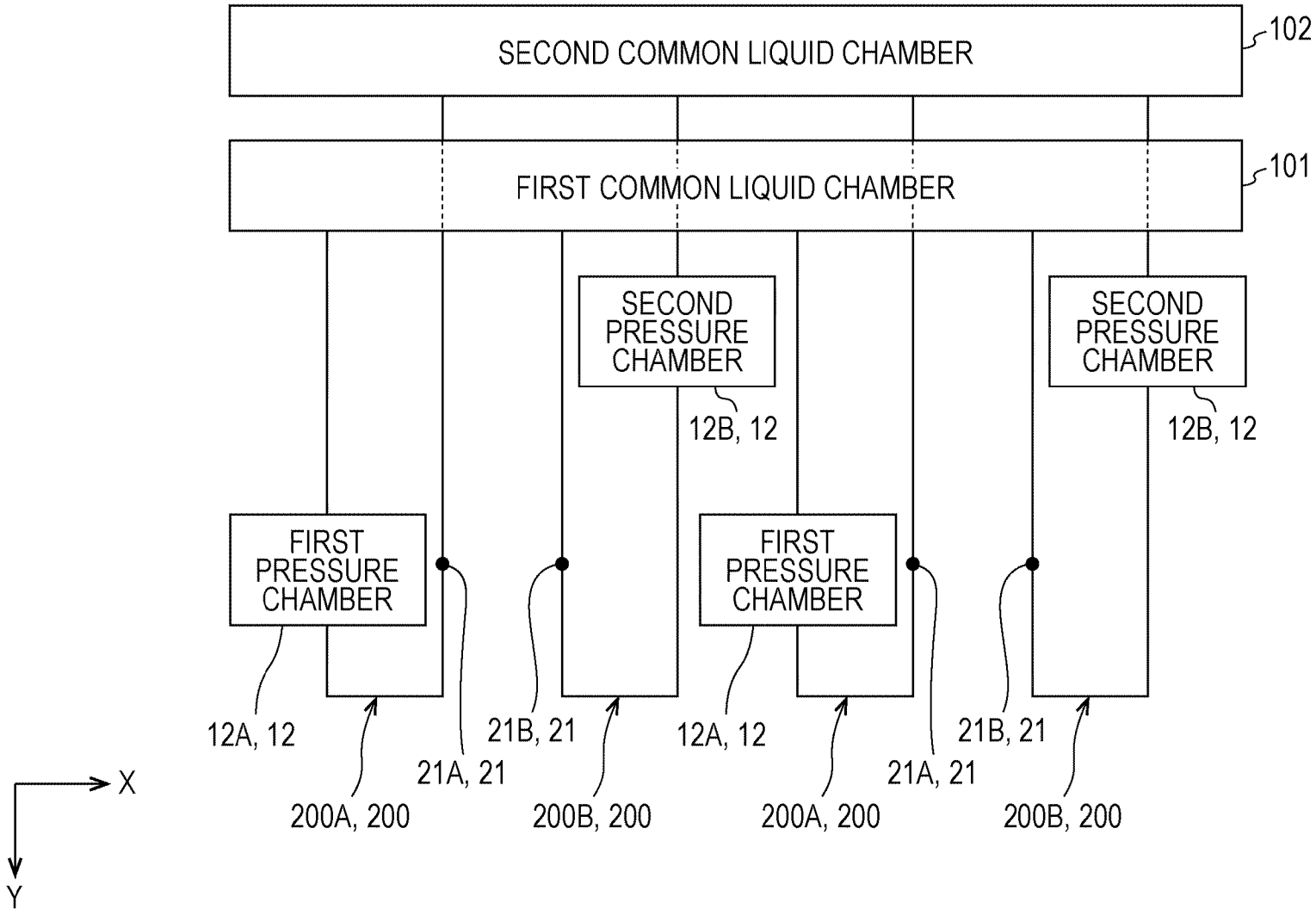
FIG. 16 is a diagram schematically illustrating flow paths according to the embodiment of the present disclosure.

In addition, in each of the embodiments described above, the configuration where the individual flow path 200 is provided between the first common liquid chamber 101 and the second common liquid chamber 102 in the Y direction is exemplified; however, the present disclosure is not specifically limited to the configuration. Herein, a modification example of the recording head 1 will be described with reference to FIGS. 14 to 16. Incidentally, FIG. 14 is a schematic cross-sectional view describing a flow path configuration which is taken along a line XIV-XIV in FIG. 6. FIG. 15 is a schematic cross-sectional view describing the flow path configuration which is taken along a line XV-XV in FIG. 6. FIG. 16 is a diagram schematically illustrating flow paths.

As illustrated in FIGS. 14 and 15, the first common liquid chamber 101 and the second common liquid chamber 102 are arranged side by side in the Y direction. In addition, the nozzle 21 of the individual flow path 200 which delivers the ink from the first common liquid chamber 101 to the second common liquid chamber 102 is disposed opposite to the first common liquid chamber 101 and the second common liquid chamber 102 in the Y direction.

Specifically, the individual flow path 200 includes the first individual flow path 200A having the first nozzle 21A, and the second individual flow path 200B having the second nozzle 21B.

As illustrated in FIG. 14, the first individual flow path 200A includes the first nozzle 21A; the first pressure chamber 12A; the first flow path 201A; the second flow path 202A; and the first supply path 203A. The first supply path 203A extends along the Y direction from the first common liquid chamber 101 toward a side which is opposite to the second common liquid chamber 102 in the Y direction. The first pressure chamber 12A is disposed in a portion of the flow path substrate 400 which is close to the −Z side. The second flow path 202A extends along the Z direction, and the first pressure chamber 12A communicates with the first flow path 201A through the second flow path 202A. The first flow path 201A extends along the Y direction, and the second flow path 202A communicates with the second common liquid chamber 102 through the first flow path 201A. Namely, the first individual flow path 200A extends from the first common liquid chamber 101 toward the side which is opposite to the second common liquid chamber 102 in the Y direction. The first individual flow path 200A is provided to communicate with the second common liquid chamber 102.

In the first individual flow path 200A described above, the first pressure chamber 12A and the first nozzle 21A are disposed in the order with respect to the ink flow direction from the first common liquid chamber 101 toward the second common liquid chamber 102.

As illustrated in FIG. 15, the second individual flow path 200B includes the second nozzle 21B; the second pressure chamber 12B; the first flow path 201B; the second flow path 202B; the second supply path 203B; and the sixth flow path 206.

The second supply path 203B extends along the Y direction, and the second pressure chamber 12B communicates with the second common liquid chamber 102 through the second supply path 203B.

The second pressure chamber 12B is disposed in a portion of the flow path substrate 400 which is close to the −Z side.

In addition, the second pressure chamber 12B is disposed at a position which is different from the position of the first pressure chamber 12A in the Y direction.

The second flow path 202B extends along the Z direction, and the second pressure chamber 12B communicates with the first flow path 201B through the second flow path 202B.

The first flow path 201B extends along the Y direction, and the second flow path 202B communicates with the sixth flow path 206 through the first flow path 201B.

The sixth flow path 206 extends along the Z direction, and the first flow path 201B communicates with the first common liquid chamber 101 through the sixth flow path 206.

Namely, the second individual flow path 200B extends from the first common liquid chamber 101 toward the side which is opposite to the second common liquid chamber 102 in the Y direction. The second individual flow path 200B is provided to communicate with the second common liquid chamber 102.

In the second individual flow path 200B described above, the second nozzle 21B and the second pressure chamber 12B are disposed in the order with respect to the ink flow direction from the first common liquid chamber 101 toward the second common liquid chamber 102. Namely, as illustrated in FIG. 16, the order of disposition of the pressure chamber 12 and the nozzle 21 with respect to the flow of the ink from the first common liquid chamber 101 toward the second common liquid chamber 102 differs between the first individual flow path 200A and the second individual flow path 200B. In the embodiment, since each of the individual flow paths 200 is provided with one pressure chamber 12 and one nozzle 21, the order of disposition of the pressure chamber 12 and the nozzle 21 is reversed between the first individual flow path 200A and the second individual flow path 200B.

In the configuration described above, since the order of the pressure chamber 12 and the nozzle 21 differs between the first individual flow path 200A and the second individual flow path 200B, it is possible to dispose the first pressure chamber 12A and the second pressure chamber 12B at different positions in the Y direction, and it is possible to increasing the excluded volume, or to dispose the pressure chambers 12 at a high density by widening the width of the pressure chamber 12 in the X direction which is the direction where the nozzles 21 are arranged side by side.

In addition, since the first nozzle 21A and the second nozzle 21B communicate with portions in the middle of the first flow path 201A and the first flow path 201B, respectively, the ink thickened by the first nozzle 21A and the second nozzle 21B or infiltrated air bubbles are capable of flowing downstream by virtue of the ink flowing through the first flow path 201A and the first flow path 201B at a high flow speed. Therefore, it is possible to prevent the occurrence of a discharge defect caused by the thickened ink or air bubbles.

In addition, in the recording head 1 illustrated in FIGS. 14 and 15, the first nozzle 21A and the second nozzle 21B are disposed on one side in the Y direction with respect to the first common liquid chamber 101 and the second common liquid chamber 102, but may be disposed on both sides. Namely, the individual flow path 200 may be provided on both sides in the Y direction with respect to one first common liquid chamber 101, and the individual flow path 200 may be provided on both sides in the Y direction with respect to one second common liquid chamber 102.

Incidentally, compared to the configuration described above where the nozzle 21 is not provided between the first common liquid chamber 101 and the second common liquid chamber 102 in the plan view from the Z direction which is the normal direction of the nozzle surface 20*a* illustrated in FIGS. 14 and 15, as in each of the embodiments described above, in the configuration where the nozzle 21 is provided between the first common liquid chamber 101 and the second common liquid chamber 102 in the plan view from the Z direction, it is possible to simplify the configuration of the individual flow path 200, and it is possible to prevent the multi-layering of the communication plate 15.

In addition, in each of the embodiments described above, the configuration where one nozzle 21 and one pressure chamber 12 are provided for each of the individual flow paths 200 is exemplified, but the number of the nozzles 21 and the number of the pressure chambers 12 are not specifically limited. Two or more plurality of the nozzles 21 may be provided for one pressure chamber 12, and two or more plurality of the pressure chambers 12 may be provided for one nozzle 21. However, ink droplets are simultaneously discharged in one discharge period from the nozzles 21 provided in one individual flow path 200. Namely, even though the plurality of nozzles 21 are provided in one individual flow path 200, only either of a discharge mode in which ink droplets are simultaneously discharged from the plurality of nozzles 21 and a non-discharge mode in which ink droplets are not simultaneously discharged therefrom is performed. However, in the configuration where the plurality of nozzles 21 are provided in one individual flow path 200, the discharge mode in which ink droplets are discharged from the plurality of nozzles 21 and the non-discharge mode in which ink droplets are not discharged therefrom may not be simultaneously performed.

In addition, in each of the embodiments described above, the flow path substrate has the flow path formation substrate 10, the communication plate 15, the nozzle plate 20, the compliance substrate 49, the case member 40, and the like; however, the present disclosure is not specifically limited to the configuration. The flow path substrate may be one piece of substrate, or may be formed by laminating two or more plurality of pieces of substrates on top of each other. For example, the flow path substrate may include the flow path formation substrate 10 and the nozzle plate 20, and may not include the communication plate 15, the compliance substrate 49, and the case member 40. In addition, one pressure chamber 12 may be formed by a plurality of the flow path formation substrates 10, and the pressure chamber 12, the first common liquid chamber 101, and the second common liquid chamber 102 may be formed in the flow path formation substrate 10.

In addition, in each of the embodiments described above, the piezoelectric actuator 300 which is a thin film type is described as an energy generating element that induces a pressure change in the pressure chamber 12; however, the present disclosure is not specifically limited to the type. It is possible to use, for example, a thick film type piezoelectric actuator formed by a method such as pasting green sheets together, or a longitudinal vibration type piezoelectric actuator in which a piezoelectric material and an electrode forming material are alternately laminated on top of each other and which expands and contracts in an axial direction. In addition, as an energy generating element, it is possible to use, for example, an actuator in which a heating element is disposed in a pressure chamber and discharges liquid droplets from a nozzle by means of bubbles formed by heat of the heating element, or a so-called electrostatic actuator that discharges liquid droplets from a nozzle opening by generating static electricity between a vibrating plate and an electrode, and deforming the vibrating plate with the static electricity.

Herein, one example of an ink jet type recording apparatus which is one example of the liquid ejecting apparatus of the embodiment will be described with reference to FIG. 17. Incidentally, FIG. 17 is a view illustrating a schematic configuration of the ink jet type recording apparatus of the present disclosure.

Figure 17:
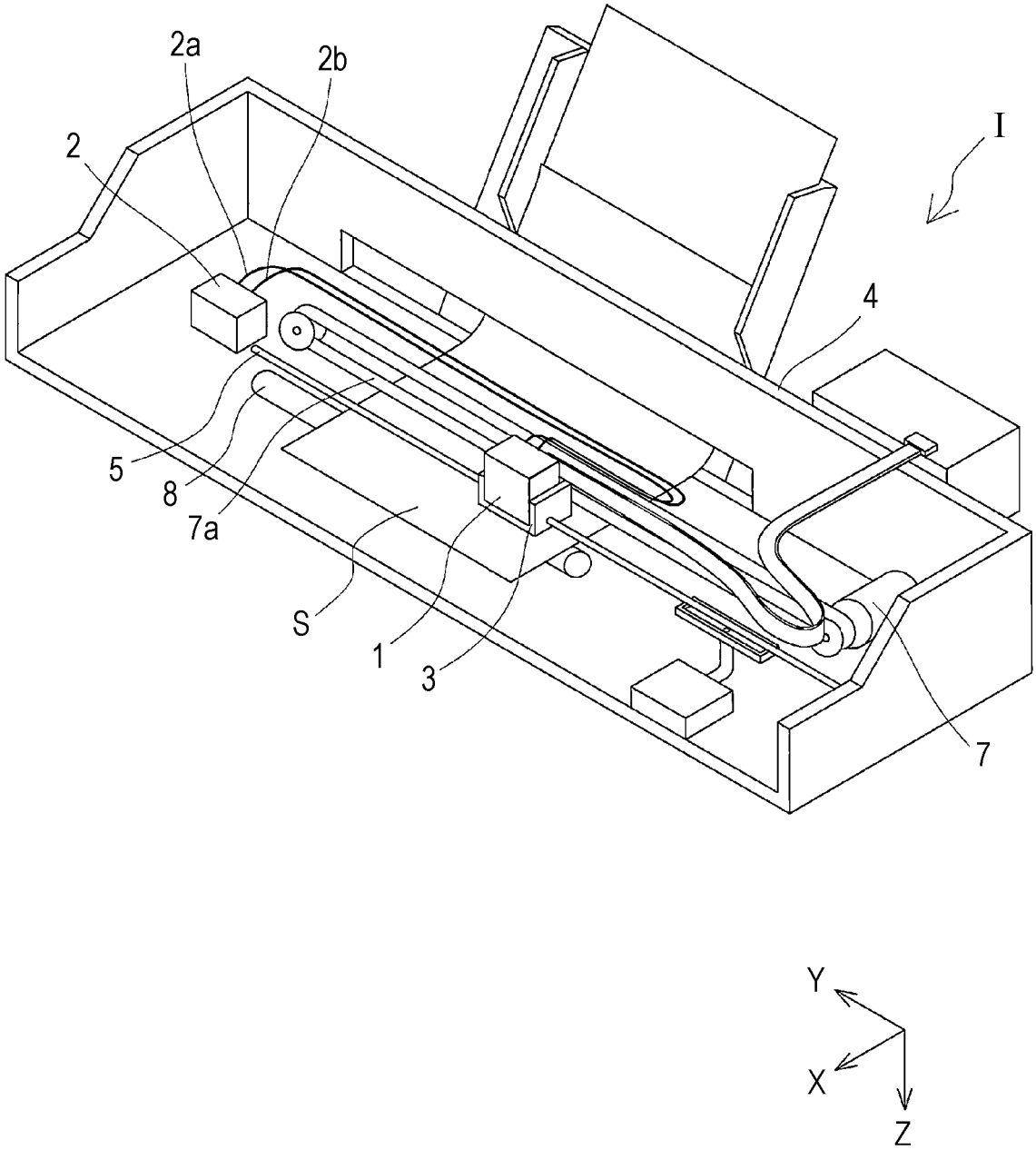
FIG. 17 is a view illustrating a schematic configuration of a recording apparatus according to one embodiment of the present disclosure.

As illustrated in FIG. 17, in an ink jet type recording apparatus I which is one example of the liquid ejecting apparatus, a plurality of the recording heads 1 are mounted on a carriage 3. The carriage 3 on which the recording heads 1 are mounted are provided on a carriage shaft 5 attached to an apparatus main body 4, so as to be movable in an axial direction. In the embodiment, a movement direction of the carriage 3 is the Y direction.

In addition, the apparatus main body 4 is provided with a tank 2 which is a storage unit that stores an ink as a liquid. The tank 2 is coupled to the recording heads 1 via a supply pipe 2*a* such as a tube, and the ink from the tank 2 is supplied to the recording heads 1 via the supply pipe 2*a*. In addition, the recording heads 1 are coupled to the tank 2 via an outlet pipe 2*b* such as a tube, and the ink flowing out from the recording heads 1 returns to the tank 2 via the outlet pipe 2*b*, namely, so-called circulation is performed. Incidentally, a plurality of the tanks 2 may be provided.

If a drive force of a drive motor 7 is transmitted to the carriage 3 via a plurality of gears (not illustrated) and a timing belt 7*a*, the carriage 3 on which the recording heads 1 are mounted move along the carriage shaft 5. On the one hand, a transport roller 8 as a transport unit is provided in the apparatus main body 4, and a recorded sheet S such as paper which is an ejection target medium is transported by the transport roller 8. Incidentally, the transport unit which transports the recorded sheet S is not limited to the transport roller 8, and may be a belt, a drum, or the like. In the embodiment, a transport direction of the recorded sheet S is the X direction.

Incidentally, in the ink jet type recording apparatus I described above, a configuration where the recording heads 1 are mounted on the carriage 3 and move in a main scanning direction is exemplified; however, the present disclosure is not specifically limited to the configuration. The present disclosure can be applied, for example, also to a so-called line type recording apparatus that performs printing only by moving the recorded sheet S such as paper in an auxiliary scanning direction in a state where the recording heads 1 are fixed.

Incidentally, in each of the embodiments, the ink jet type recording head and the ink jet type recording apparatus are exemplarily described as one example of the liquid ejecting head and one example of the liquid ejecting apparatus, respectively. The present disclosure is intended for a wide range of liquid ejecting heads and liquid ejecting apparatuses in general, and naturally, can be applied also to liquid ejecting heads or liquid ejecting apparatuses which eject liquids other than an ink. Examples of other liquid ejecting heads include various recording heads used in image recording apparatuses such as a printer, a color material ejecting head used to manufacture color filters such as a liquid crystal display, an electrode material ejecting head used to form electrodes such as an organic EL display and a field emission display (FED), a bioorganic matter ejecting head used to manufacture biochips. The present disclosure can be applied also to liquid ejecting apparatuses including the liquid ejecting heads.

What is claimed is:

1. A liquid ejecting head comprising:

a flow path substrate which includes a nozzle plate and in which a flow path is formed; and an energy generating element inducing a change in a pressure of a liquid in the flow path, wherein the flow path includes a first common liquid chamber, a second common liquid chamber, and a plurality of individual flow paths which communicate with the first common liquid chamber and the second common liquid chamber and through which the liquid flows from the first common liquid chamber toward the second common liquid chamber, and the individual flow path includes a nozzle communicating with an outside, a first flow path, in the middle of which the nozzle is disposed and which extends in a first direction that is an in-plane direction of a nozzle surface of the nozzle plate in which the nozzle opens, a second flow path coupled to the first flow path and extending in a second direction other than the first direction, a third flow path coupled to the second flow path and extending in a third direction other than the second direction, and a pressure chamber which is disposed in the third flow path and in which a pressure change is induced by the energy generating element, and a cross-sectional area of the first flow path is smaller than a cross-sectional area of the second flow path.

2. The liquid ejecting head according to claim 1, wherein the nozzle is disposed in the first flow path at a position close to the second flow path.

3. The liquid ejecting head according to claim 1, wherein a flow path resistance between the pressure chamber and the nozzle of the individual flow path is smaller than a flow path resistance between the nozzle and the second common liquid chamber, and an inertance between the pressure chamber and the nozzle of the individual flow path is smaller than an inertance between the nozzle and the second common liquid chamber.

4. The liquid ejecting head according to claim 1, wherein a portion in the first flow path, in which a line connecting positions where a flow speed of the liquid flowing through the first flow path becomes the maximum is the closest to the nozzle plate, is positioned in the nozzle in a plan view from a normal direction of the nozzle surface.

5. The liquid ejecting head according to claim 1, wherein in a plan view from a direction where the liquid flows through the first flow path, a width of the first flow path in a direction where the nozzles are arranged side by side is smaller than a height of the first flow path in a normal direction of the nozzle surface.

6. The liquid ejecting head according to claim 1, wherein in a plan view from a direction where the liquid flows through the first flow path, a width of the first flow path in a direction where the nozzles are arranged side by side is larger than a height of the first flow path in a normal direction of the nozzle surface.

7. The liquid ejecting head according to claim 1, wherein in a plan view from a direction where the liquid flows through the first flow path, a width of the first flow path in a direction where the nozzles are arranged side by side is smaller than a width of the second flow path.

8. The liquid ejecting head according to claim 1, wherein the nozzle has a first hole and a second hole that have different inner diameters, and the first hole and the second hole are formed side by side in a normal direction of the nozzle surface of the nozzle plate.

9. The liquid ejecting head according to claim 1, wherein a viscosity of the liquid is greater than or equal to 20 mPa·s.

10. The liquid ejecting head according to claim 1, wherein a thickness of the nozzle plate is from 60 μm to 100 μm.

11. The liquid ejecting head according to claim 1, wherein among the plurality of individual flow paths, three individual flow paths which are adjacent to each other in a direction where the nozzles are arranged side by side communicate with the first common liquid chamber and the second common liquid chamber, and an arrangement order of the pressure chamber and the nozzle in a liquid flow direction from the first common liquid chamber toward the second common liquid chamber differs between two individual flow paths which are adjacent to each other in the direction where the nozzles are arranged side by side.

12. A liquid ejecting apparatus comprising:

the liquid ejecting head according to claim 1.

* * * * *